US006161971A

United States Patent [19]

Suzuki et al.

[11] Patent Number: 6,161,971

[45] **Date of Patent: *Dec. 19, 2000**

[54] IMAGE-FORMING SYSTEM

[75] Inventors: Minoru Suzuki, Tochigi; Hiroshi Orita; Hiroyuki Saito, both of Saitama; Katsuyoshi Suzuki; Koichi Furusawa, both of Tokyo, all of Japan

[73] Assignee: Asahi Kogaku Kogyo Kabushiki Kaisha, Tokyo, Japan

[ * ] Notice: This patent is subject to a terminal disclaimer.

[21] Appl. No.: 09/189,863

[22] Filed: Nov. 12, 1998

[30] Foreign Application Priority Data

Nov. 14, 1997 [JP] Japan ..... 09-331299

[51] Int. Cl.[7] ..... B41J 2/315

[52] U.S. Cl. ..... 400/120.01; 400/120.07; 400/120.08; 347/171; 347/172

[58] Field of Search ..... 400/120.01, 120.08, 400/120.07; 430/138; 428/321.5; 347/171, 172; 503/227

[56] References Cited

U.S. PATENT DOCUMENTS

| | | | |
|---|---|---|---|
| Re. 33,525 | 1/1991 | Iwasaki | 396/583 |
| 4,644,376 | 2/1987 | Usami et al. | 503/215 |
| 4,973,542 | 11/1990 | Takenouchi et al. | 430/138 |
| 4,990,931 | 2/1991 | Sato et al. | 347/232 |
| 5,053,309 | 10/1991 | Sanders et al. | 430/138 |
| 5,072,245 | 12/1991 | Tamura et al. | 347/212 |
| 5,246,811 | 9/1993 | Higuchi | 430/138 |
| 5,573,885 | 11/1996 | Inui et al. | 430/138 |
| 5,736,996 | 4/1998 | Takada et al. | 347/19 |
| 5,884,114 | 3/1999 | Iwasaki | 396/583 |
| 5,897,254 | 4/1999 | Tanaka et al. | 400/120.07 |

FOREIGN PATENT DOCUMENTS

| | | |
|---|---|---|
| 57-187296 | 11/1982 | Japan . |
| 4-4960 | 12/1985 | Japan . |

*Primary Examiner*—John S. Hilten
*Assistant Examiner*—Minh Chau
*Attorney, Agent, or Firm*—Greenblum & Bernstein P.L.C.

[57] ABSTRACT

An image-forming system has an image-forming substrate that includes a base sheet, and a layer of microcapsules, coated over the base sheet, containing a plurality of at least one type of microcapsules filled with an ink. When a dot area of the layer of microcapsules is subjected to a pressure in a predetermined pressure range at a temperature in a predetermined temperature range, at least a portion of the plurality of at least one type of microcapsules, included in the dot area, are squashed and broken, thereby causing discharge of the dye from the squashed and broken microcapsules. A thermal printer includes a roller platen for exerting the pressure on the dot area, a thermal head for applying a thermal energy to the dot area to heat the same to the predetermined temperature, and a regulator that regulates a degree of application of the thermal energy to the dot area, thereby enabling a variation in the density of the discharge of the dye at the dot area to be obtainable.

26 Claims, 18 Drawing Sheets

$D_1$ : ENERGIZATION TIME $t_1$
$D_2$ : ENERGIZATION TIME $t_2$
$D_3$ : ENERGIZATION TIME $t_3$

TABLE I

| IMAGE-PIXEL SIGNAL (C, M, Y) | 2-BIT GRADATION SIGNAL (C, M, Y) | PULSE WIDTH OF "DAC", "DAM" AND "DAY" |
|---|---|---|
| [0] | [00] | (LOW LEVEL) |
| [1] | [01] | $PWC_1$ ; $PWM_1$ ; $PWY_1$ |
| [1] | [10] | $PWC_2$ ; $PWM_2$ ; $PWY_2$ |
| [1] | [11] | $PWC_3$ ; $PWM_3$ ; $PWY_3$ |

TABLE II

| IMAGE-PIXEL SIGNAL (C, M, Y) | 2-BIT GRADATION SIGNAL (C, M, Y) | NUMBER OF TIMES OF PULSE OUTPUTTING |
|---|---|---|
| [0] | [00] | 0 |
| [1] | [01] | 1 |
| [1] | [10] | 2 |
| [1] | [11] | 3 |

FIG. 25

TABLE III

| IMAGE-PIXEL SIGNAL (SC, SM, SY) | CONTROL SIGNAL (DA) | 2-BIT GRADATION SIGNAL | 4-BIT CONTROL SIGNAL | HIGH-FREQUENCY VOLTAGE SIGNAL |
|---|---|---|---|---|
| SC [0]<br>SM [0]<br>SY [0] | (LOW LEVEL) | GSC [00]<br>GSM [00]<br>GSY [00] | $DVB_n$ [0000] | (NO OUTPUT) |
| SC [1]<br>SM [0]<br>SY [0] | PC (H) | GSC [01]<br>GSC [10]<br>GSC [11] | $DVB_n$ [0001]<br>$DVB_n$ [0010]<br>$DVB_n$ [0011] | $f_{C1}$ ($P_{C1}$)<br>$f_{C2}$ ($P_{C2}$)<br>$f_{C3}$ ($P_{C3}$) |
| SC [0]<br>SM [1]<br>SY [0] | PM (H) | GSM [01]<br>GSM [10]<br>GSM [11] | $DVB_n$ [0100]<br>$DVB_n$ [0101]<br>$DVB_n$ [0110] | $f_{M1}$ ($P_{M1}$)<br>$f_{M2}$ ($P_{M2}$)<br>$f_{M3}$ ($P_{M3}$) |
| SC [0]<br>SM [0]<br>SY [1] | PY (H) | GSY [01]<br>GSY [10]<br>GSY [11] | $DVB_n$ [0111]<br>$DVB_n$ [1000]<br>$DVB_n$ [1001] | $f_{Y1}$ ($P_{Y1}$)<br>$f_{Y2}$ ($P_{Y2}$)<br>$f_{Y3}$ ($P_{Y3}$) |

IMAGE-FORMING SYSTEM

BACKGROUND OF THE INVENTION

1. Field of the Invention

The present invention relates to an image-forming system for forming an image on an image-forming substrate, coated with a layer of microcapsules filled with dye or ink, by selectively breaking or squashing the microcapsules in the layer of microcapsules. Also, the present invention relates to an image-forming apparatus, used in the image-forming system, for forming an image on the image-forming substrate.

2. Description of the Related Art

Conventionally, a color-image-forming system, using an image-forming substrate coated with a layer of microcapsules filled with different color dyes or inks, is known. In this color-image-forming apparatus, the respective different colors are selectively developed on the microcapsule layer of the image-forming substrate by applying specific temperatures to the color microcapsule layer, and a developed color is fixed by irradiation, using a light of a specific wavelength.

In this conventional image-forming system, each pixel, forming a part of a developed image, corresponds to a single digital image-pixel signal, and is produced as a dot on the microcapsule layer of the image-forming substrate. A size of each dot is larger than an average size of the microcapsules forming the microcapsule layer, and thus a plurality of microcapsules is included in each dot.

In the conventional system, there is no method for properly controlling a number of microcapsules to be broken or Squashed when producing each dot, so as to obtain a variation in density (gradation) of a dot generated by the broken and squashed microcapsules.

SUMMARY OF THE INVENTION

Therefore, an object of the present invention is to provide an image-forming system that forms an image on an image-forming substrate, coated with a layer of microcapsules filled with dye or ink, by selectively breaking or squashing the microcapsules in the layer of microcapsules, wherein a number of microcapsules to be broken or squashed when producing each dot can be properly controlled, thereby controlling a variation in density (gradation) of a dot developed from the broken microcapsules.

Another object of the present invention is to provide an image-forming apparatus, which can be advantageously and suitably used in the image-forming system.

In accordance with an aspect of the present invention, there is provided an image-forming system which comprises an image-forming substrate that includes a base member, and a layer of microcapsules coated over the base member. The layer of microcapsules contains a plurality of at least one type of microcapsules filled with a dye, and the one type of microcapsules exhibits a temperature/pressure characteristic such that, when a local area of the layer of microcapsules is subjected to a pressure in a predetermined pressure range at a temperature in a predetermined temperature range, at least a portion of the plurality of at least one type of microcapsules, included in the local area are squashed and broken, so that the dye discharges from the squashed and broken microcapsules. The local area may be a dot area which corresponds to a pixel unit of an image to be formed on the layer of microcapsules.

The image-forming system further comprises an image-forming unit that includes a pressure applicator that exerts the pressure on the local area, a thermal heater that applies thermal energy to the local area to heat the local area to the temperature, and a regulator that regulates a degree of the application of the thermal energy to the local area, so that a variation in density of the discharged dye at the local area is obtainable. In this case, preferably, the regulator includes a determiner that determines whether the application of the thermal energy to the local area is performed in accordance with image information, and the regulation of the application of the thermal energy to the local area is carried out in accordance with gradation information included in the image information.

Optionally, the regulator may regulate an amount of the pressure exerted on the local area, so that a variation in density of the discharged dye at the local area is obtainable. In this case, preferably, the regulator includes a determiner that determines whether the exertion of the pressure on the local area is performed in accordance with image information, and the regulation of the pressure exerted on the local area is carried out in accordance with gradation information included in the image information.

In accordance with a second aspect of the present invention, there is provided an image-forming apparatus that forms an image on an image-forming substrate that includes a base member, and a layer of microcapsules, coated over the base member, containing a plurality of at least one type of microcapsules filled with a dye, the one type of microcapsules exhibiting a temperature/pressure characteristic such that, when a local area of the layer of microcapsules is subjected to a pressure in a predetermined pressure range at a temperature in a predetermined temperature range, at least a portion of the plurality of at least one type of microcapsules, included in the local area, are squashed and broken, so that the dye discharges from the squashed and broken microcapsules to form the image.

The image-forming apparatus comprises a pressure applicator that exerts the pressure on the local area, a thermal heater that applies thermal energy to the local area to heat the local area to the temperature, and a regulator that regulates a degree of the application of the thermal energy to the local area, so that a variation in density of the discharged dye at the local area is obtainable.

Optionally, a regulator may regulate an amount of the pressure exerted on the local area, so that a variation in density of the discharged dye at the local area is obtainable.

BRIEF DESCRIPTION OF THE DRAWINGS

These object and other objects of the present invention will be better understood from the following description, with reference to the accompanying drawings in which:

FIG. 25 is a table showing a relationship between three-primary color digital image-pixel signals, inputted to a control signal generator of FIG. 23, and four kinds of control signals, outputted from the control signal generator, and a relationship between the three-primary color digital image-pixel signals, inputted to a 4-bit control signal generator of FIG. 23; four kinds of 4-bit control signals, outputted from the 4-bit control signal generator and inputted to the high-frequency voltage power source; and nine kinds of high-frequency voltages, outputted from the high-frequency voltage power source.

DESCRIPTION OF THE PREFERRED EMBODIMENTS

Figure 1:
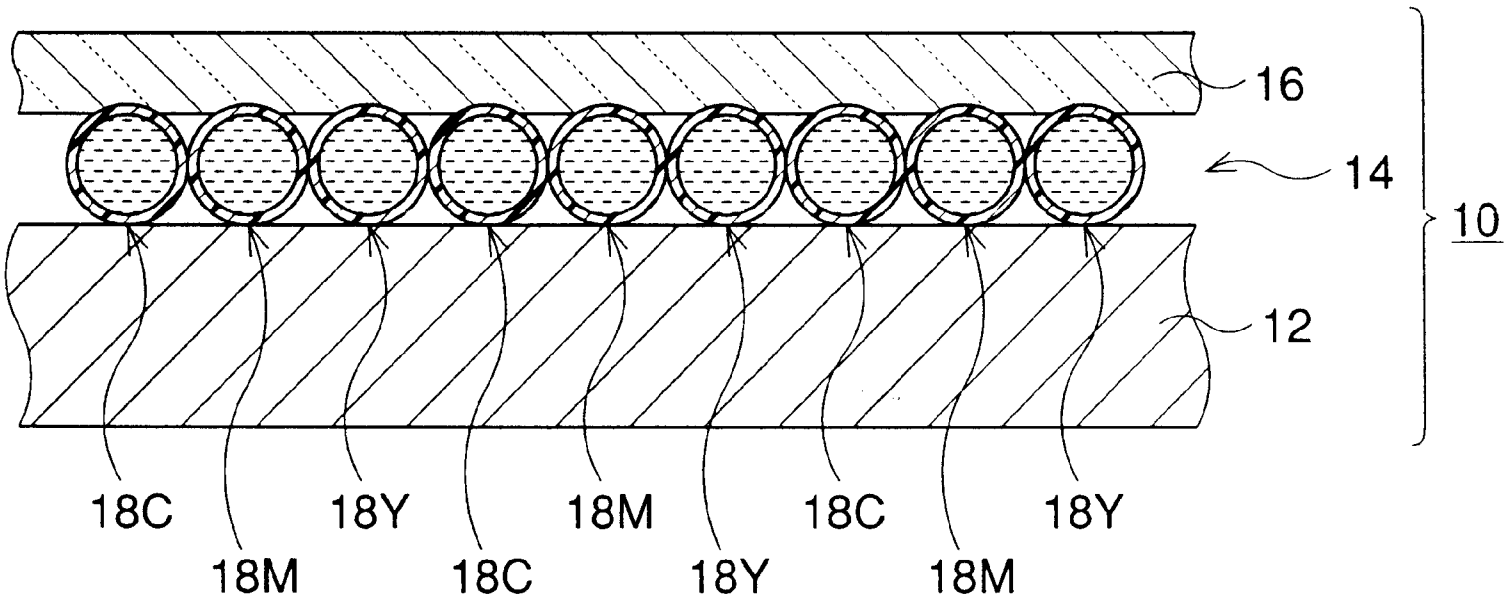
FIG. 1 is a schematic conceptual cross-sectional view showing an image-forming substrate, using three types of microcapsules: cyan microcapsules filled with a cyan dye; magenta microcapsules filled with a magenta dye; and yellow microcapsules filled with a yellow dye, used in an image-forming system according to the present invention.

FIG. 1 shows an image-forming substrate, generally indicated by reference 10, which may be used in an image-forming system according to the present invention. The image-forming substrate 10 is produced in a form of paper sheet. In particular, the image-forming substrate 10 comprises a sheet of paper 12, a layer of microcapsules 14 coated over a surface of the sheet of paper 12, and a sheet of protective transparent film 16 covering the layer of microcapsules 14.

The microcapsule layer 14 is formed of three types of microcapsules: a first type of microcapsules 18C filled with cyan liquid dye or ink, a second type of microcapsules 18M filled with magenta liquid dye or ink, and a third type of microcapsules 18Y filled with yellow liquid dye or ink, and these microcapsules 18C, 18M and 18Y are uniformly distributed in the layer of microcapsules 14.

In each type of microcapsule (18C, 18M, 18Y), a shell wall of a microcapsule is formed of a synthetic resin material, usually colored white, which is the same color as the sheet of paper 14. Accordingly, if the sheet of paper 14 is colored with a single color pigment, the resin material of the microcapsules 18C, 18M and 18Y may be colored by the same single color pigment.

In order to produce each of the types of microcapsules 18C, 18M and 18Y, a polymerization method, such as interfacial polymerization, in-situ polymerization or the like, may be utilized. In either case, the microcapsules 18C, 18M and 18Y may have an average diameter of several microns, for example, 5 $\mu$m to 10 $\mu$m.

For the uniform formation of the layer of microcapsules 14, for example, the same amounts of cyan, magenta and yellow microcapsules 18C, 18M and 18Y are homogeneously mixed with a suitable binder solution to form a suspension, and the sheet of paper 12 is coated with the binder solution, containing the suspension of microcapsules 18C, 18M and 18Y, by using an atomizer. In FIG. 1, for the convenience of illustration, although the layer of microcapsules 14 is shown as having a thickness corresponding to the diameter of the microcapsules 18C, 18M and 18Y, in reality, the three types of microcapsules 18C, 18M and 18Y overlay each other, and thus the layer of microcapsules 14 has a larger thickness than the diameter of a single microcapsule 18C, 18M or 18Y.

In the image-forming substrate 10 shown in FIG. 1, for the resin material of each type of microcapsule (18C, 18M, 18Y), a shape memory resin is utilized. For example, the shape memory resin is represented by a polyurethane-based-resin, such as polynorbornene, trans-1, 4-polyisoprene polyurethane. As other types of shape memory resin, a polyimide-based resin, a polyamide-based resin, a polyvinylchloride-based resin, a polyester-based resin and so on are also known.

Figure 2:
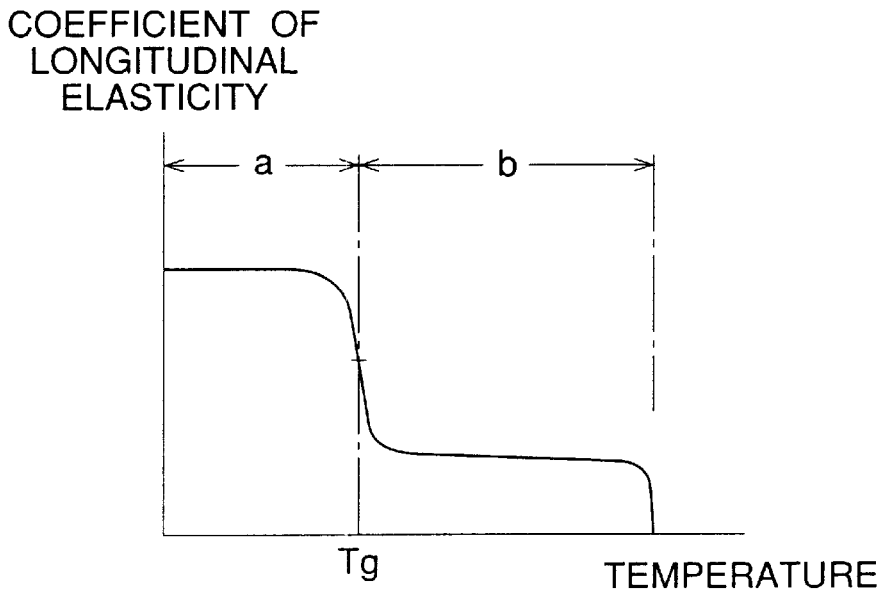
FIG. 2 is a graph showing a characteristic curve of a longitudinal elasticity coefficient of a shape memory resin.

In general, as shown in a graph of FIG. 2, the shape memory resin exhibits a coefficient of longitudinal elasticity, which abruptly changes at a glass-transition temperature boundary $T_g$. In the shape memory resin, Brownian movement of the molecular chains is stopped in a low-temperature area "a", which is below the glass-transition temperature $T_g$, and thus the shape memory resin exhibits a glass-like phase. On the other hand, Brownian movement of the molecular chains becomes increasingly energetic in a high-temperature area "b", which is above the glass-transition temperature $T_g$, and thus the shape memory resin exhibits a rubber elasticity.

The shape memory resin is named due to the following shape memory characteristic: once a mass of the shape memory resin is worked into a finished article in the low-temperature area "a", and is heated to beyond the glass-transition temperature $T_g$, the article becomes freely deformable. After the shaped article is deformed into another shape, and cooled to below the glass-transition temperature $T_g$, the most recent shape of the article is fixed and maintained. Nevertheless, when the deformed article is again heated to above the glass-transition temperature $T_g$, without being subjected to any load or external force, the deformed article returns to the original shape.

In the image-forming substrate or sheet 10, the shape memory characteristic per se is not utilized, but the characteristic abrupt change of the shape memory resin in the longitudinal elasticity coefficient is utilized, such that the three types of microcapsules 18C, 18M and 1BY can be selectively broken and squashed at different temperatures and under different pressures, respectively.

Figure 3:
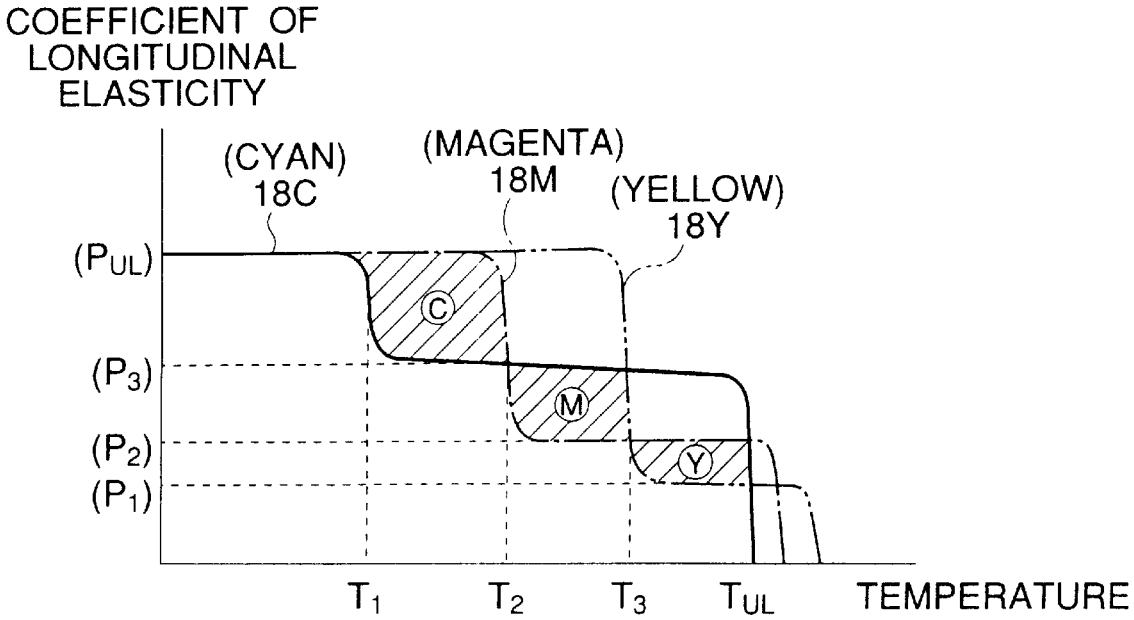
FIG. 3 is a graph showing temperature/pressure breaking characteristics of the respective cyan, magenta and yellow microcapsules shown in FIG. 1, with each of a cyan-developing area, a magenta-developing area and a yellow-developing area being indicated as a hatched area.

As shown in a graph of FIG. 3, a shape memory resin of the cyan microcapsules 18C is prepared so as to exhibit a characteristic longitudinal elasticity coefficient, indicated by a solid line, having a glass-transition temperature Ti; a shape memory resin of the magenta microcapsules 18M is prepared so as to exhibit a characteristic longitudinal elasticity coefficient, indicated by a single-chained line, having a glass-transition temperature $T_2$; and a shape memory resin of the yellow microcapsules 18Y is prepared so as to exhibit a characteristic longitudinal elasticity coefficient, indicated by a double-chained line, having a glass-transition temperature $T_3$.

Note, by suitably varying compositions of the shape memory resin and/or by selecting a suitable one from among various types of shape memory resin, it is possible to obtain the respective shape memory resins, with the glass-transition temperatures $T_1$, $T_2$ and $T_3$. The respective glass-transition temperatures $T_1$, $T_2$ and $T_3$ may be 70° C., 110° C. and 130° C., for example.

Figure 4:
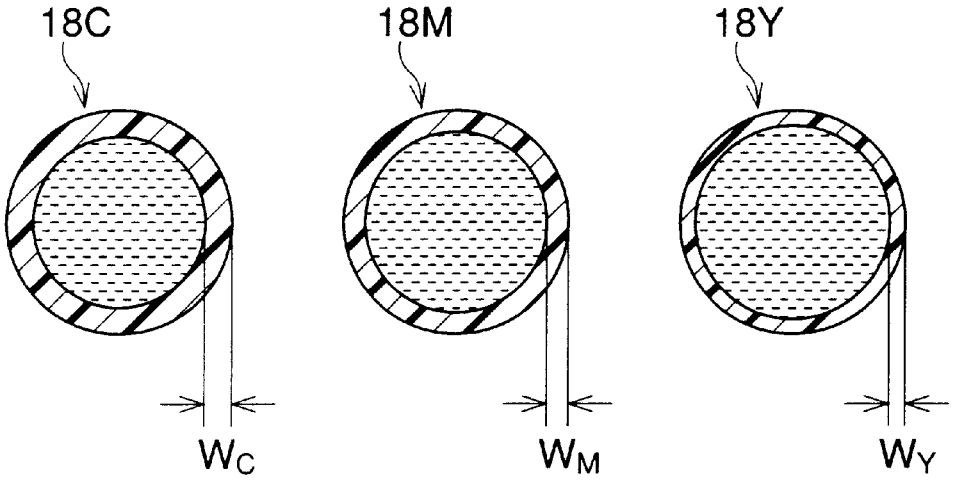
FIG. 4 is a schematic cross sectional view showing different shell wall thicknesses of the respective cyan, magenta and yellow microcapsules shown in FIG. 1.

As shown in FIG. 4, the microcapsule walls $W_C$, $W_M$ and $W_Y$ of the cyan microcapsules 18C, magenta microcapsules 18M, and yellow microcapsules 18Y, respectively, have differing thicknesses. The thickness $W_C$ of the cyan microcapsules 18C is larger than the thickness $W_M$ of the magenta microcapsules 18M, and the thickness $W_M$ of the magenta microcapsules 18M is larger than the thickness $W_Y$ of the yellow microcapsules 18Y.

The wall thickness $W_C$ of the cyan microcapsules 18C is selected such that each cyan microcapsule 18C is broken and compacted under a breaking pressure that lies between a critical breaking pressure $P_3$ and an upper limit pressure $P_{UL}$ (FIG. 3), when each cyan microcapsule 18C is heated to a temperature between the glass-transition temperatures $T_1$ and $T_2$. The wall thickness $W_M$ of the magenta microcapsules 18M is selected such that each magenta microcapsule 18M is broken and compacted under a breaking pressure that lies between a critical breaking pressure $P_2$ and the critical breaking pressure $P_3$ (FIG. 3), when each magenta microcapsule 18M is heated to a temperature between the glass-transition temperatures $T_2$ and $T_3$. The wall thickness $W_Y$ of the yellow microcapsules 18Y is selected such that each yellow microcapsule 18Y is broken and compacted under a breaking pressure that lies between a critical breaking pressure $P_1$ and the critical breaking pressure $P_2$ (FIG. 3), when each yellow microcapsule 18Y is heated to a temperature between the glass-transition temperature $T_3$ and an upper limit temperature $T_{UL}$.

Note, the upper limit pressure $P_{UL}$ and the upper limit temperature $T_{UL}$ are suitably set in view of the characteristics of the used shape memory resins.

As is apparent from the foregoing, by suitably selecting a heating temperature and a breaking pressure, which should be exerted on the image-forming sheet 10, it is possible to selectively break and squash the cyan, magenta and yellow microcapsules 18C, 18M and 18Y.

Figure 5:
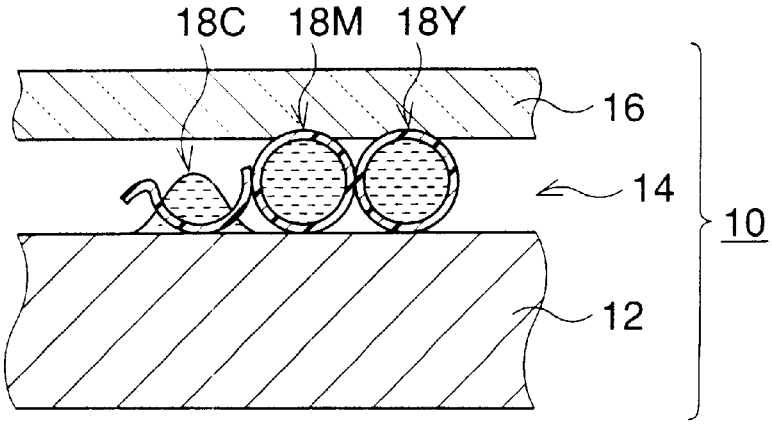
FIG. 5 is a schematic conceptual cross sectional view similar to FIG. 1, showing only a selective breakage of the cyan microcapsule in the layer of microcapsules.

For example, if the selected heating temperature and breaking pressure fall within a hatched cyan area C (FIG. 3), defined by a temperature range between the glass-transition temperatures $T_1$ and $T_2$ and by a pressure range between the critical breaking pressure $P_3$ and the upper limit pressure $P_{UL}$, only the cyan microcapsules 18C are broken and squashed, as shown in FIG. 5. Also, if the selected heating temperature and breaking pressure fall within a hatched magenta area M, defined by a temperature range between the glass-transition temperatures $T_2$ and $T_3$ and by a pressure range between the critical breaking pressures $P_2$ and $P_3$, only the magenta microcapsules 18M are broken and squashed. Further, if the selected heating temperature and breaking pressure fall within a hatched yellow area Y, defined by a temperature range between the glass-transition temperature $T_3$ and the upper limit temperature $T_{UL}$ and by a pressure range between the critical breaking pressures $P_1$ and $P_2$, only the yellow microcapsules 18Y are broken and squashed.

Accordingly, if the selection of a heating temperature and a breaking pressure, which should be exerted on the image-forming sheet 10, are suitably controlled in accordance with digital color image-pixel signals, i.e. digital cyan image-pixel signals, digital magenta image-pixel signals and digital yellow image-pixel signals, it is possible to form a color image on the image-forming sheet 10 on the basis of the digital color image-pixel signals.

Figure 6:
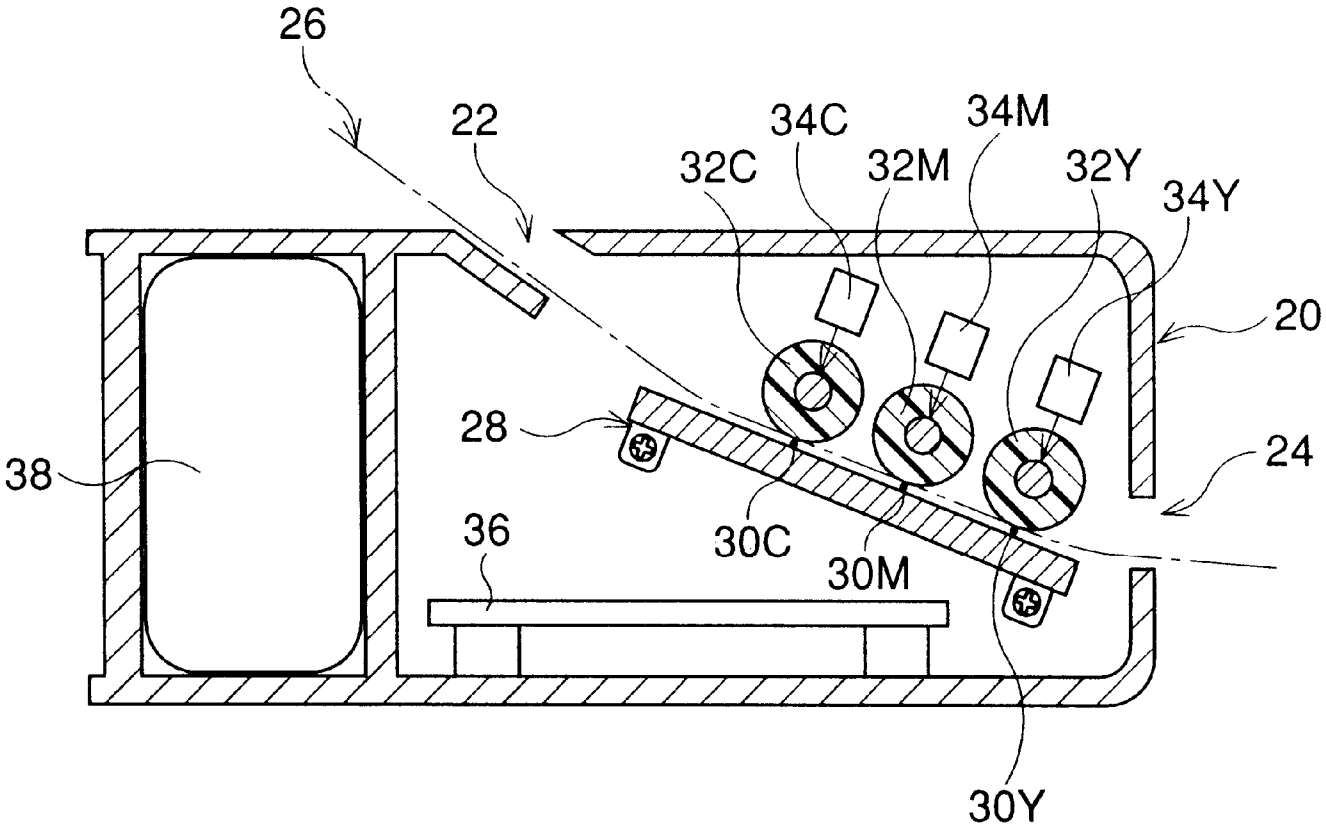
FIG. 6 is a schematic cross sectional view of a first embodiment of a color printer, according to the present invention, for forming a color image on the image-forming substrate shown in FIG. 1.

FIG. 6 schematically shows a first embodiment of a color printer, which may be used in the image-forming system according to the present invention, and which is constituted as a line printer so as to form a color image on the image-forming sheet 10.

The color printer comprises a rectangular parallelopiped housing 20 having an entrance opening 22 and an exit opening 24 formed in a top wall and a side wall of the housing 20, respectively. The image-forming sheet 10 (not shown in FIG. 6) is introduced into the housing 20 through the entrance opening 22, and is then discharged from the exit opening 24 after the formation of a color image on the image-forming sheet 10. Note, in FIG. 6, a path 26 for movement of the image-forming sheet 10 is indicated by a chained line.

A guide plate 28 is provided in the housing 20 so as to define a part of the path 26 for the movement of the image-forming sheet 10, and a first thermal head 30C, a second thermal head 30M and a third thermal head 30Y are securely attached to a surface of the guide plate 28. Each thermal head (30C, 30M, 30Y) is formed as a line thermal head extending perpendicularly with respect to a direction of the movement of the image-forming sheet 10.

Figure 7:
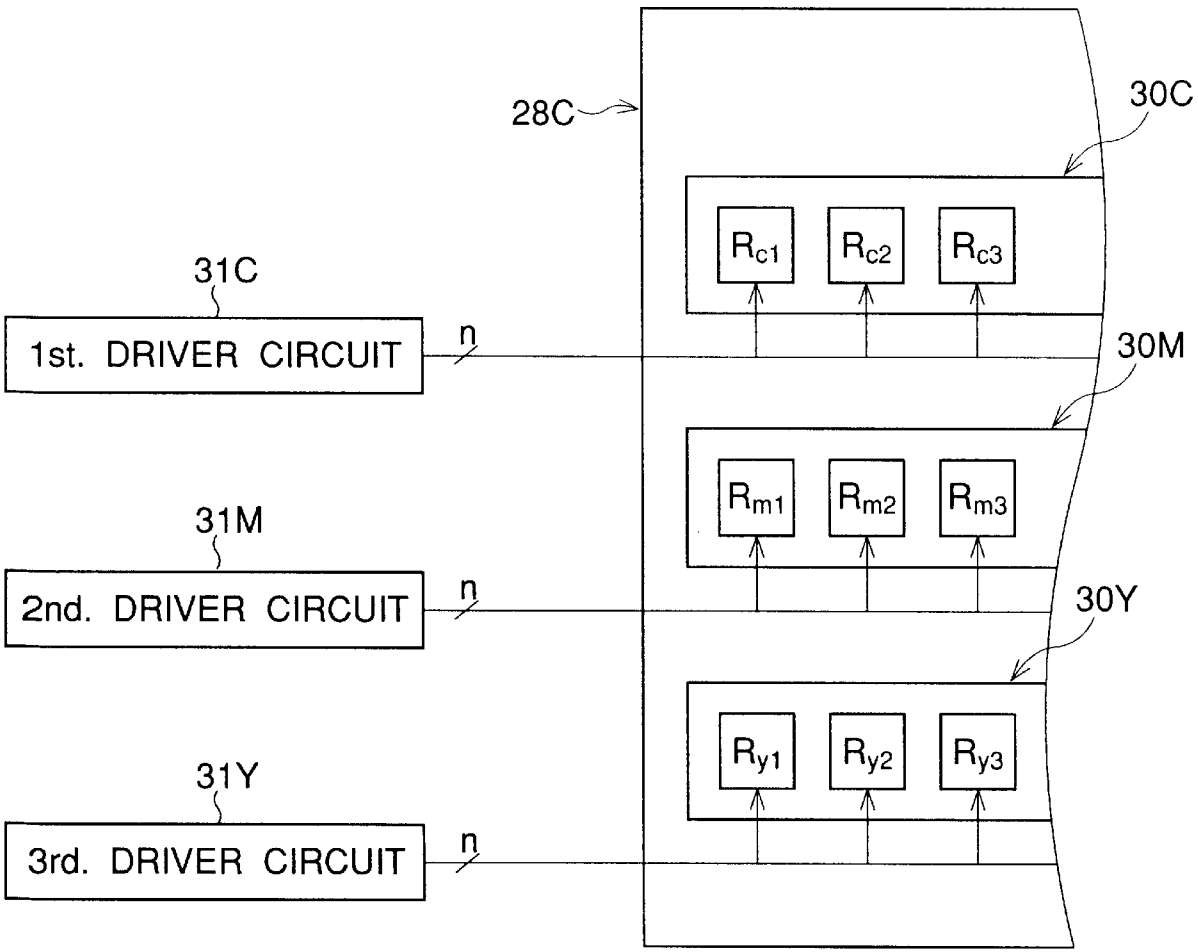
FIG. 7 is a partial schematic block diagram of three line type thermal heads and three driver circuits therefor incorporated in the color printer of FIG. 6.

As conceptually shown in FIG. 7, the line thermal head 30C includes a plurality of heater elements or electric resistance elements $R_{c1}$, to $R_{cn}$ (where n=1, 2, 3, . . . ), and these electric resistance elements $R_{c1}$, to $R_{cn}$ are aligned with each other along a length of the line thermal head 30C. Each of the electric resistance elements $R_{c1}$ to $R_{cn}$ is selectively energized by a first driver circuit 31C in accordance with a digital cyan image-pixel signal carrying a 2-bit digital gradation signal. Namely, when the digital cyan image-pixel signal has a value "1", the corresponding electric resistance element $R_{cn}$ is heated to a temperature, which falls in the range between the glass-transition temperatures $T_1$ and $T_2$, and a heated level of the corresponding resistance element $R_{cn}$ is determined in accordance with the 2-bit digital gradation signal carried by the digital cyan image-pixel signal concerned, as stated in detail hereinafter.

Also, the line thermal head 30M includes a plurality of heater elements or electric resistance elements $R_{m1}$, to $R_{mn}$ (where n=1, 2, 3, . . . ), and these electric resistance elements $R_{m1}$ to $R_{mn}$ are aligned with each other along a length of the line thermal head 30M. Each of the electric resistance elements $R_{m1}$ to $R_{mn}$ is selectively energized by a second driver circuit 31M in accordance with a magenta image-pixel signal carrying a 2-bit digital gradation signal. Namely, when the digital magenta image-pixel signal has a value "1", the corresponding electric resistance element $R_{mn}$ is heated to a temperature, which falls in the range between the glass-transition temperatures $T_2$ and $T_3$, and a heated level of the corresponding resistance element $R_{mn}$ is determined in accordance with the 2-bit digital gradation signal carried by the digital cyan magenta-pixel signal concerned, as stated in detail hereinafter.

Further, the line thermal head 30Y includes a plurality of heater elements or electric resistance elements $R_{y1}$ to $R_{yn}$ (where n=1, 2, 3, . . . ), and these resistance elements are aligned with each other along a length of the line thermal head 30Y. Each of the electric resistance elements $R_{y1}$, to $R_{yn}$ is selectively energized by a third driver circuit 31Y in accordance with a yellow image-pixel signal carrying a 2-bit digital gradation signal. Namely, when the digital yellow image-pixel signal has a value "1", the corresponding electric resistance element $R_{yn}$ is heated to a temperature, which falls in the range between the glass-transition temperatures $T_3$ and $T_{UL}$, and a heated level of the corresponding resistance element $R_{yn}$ is determined in accordance with the 2-bit digital gradation signal carried by the digital yellow image-pixel signal concerned, as stated in detail hereinafter.

Note, the line thermal heads 30C, 30M and 30Y are arranged in sequence so that the respective heating temperatures increase in the movement direction of the image-forming substrate 10.

The color printer further comprises a first roller platen 32C, a second roller platen 32M and a third roller platen 32Y (which serve as a pressure applicator) associated with the first, second and third thermal heads 30C, 30M and 30Y, respectively, and each of the roller platens 32C, 32M and 32Y may be formed of a suitable hard rubber material. The first roller platen 32C is provided with a first spring-biasing unit 34C so as to be elastically pressed against the first thermal head 30C at a pressure between the critical compacting-pressure $P_3$ and the upper limit pressure $P_{UL}$; the second roller platen 32M is provided with a second spring-biasing unit 34M so as to be elastically pressed against the second thermal head 30M at a pressure between the critical compacting-pressures $P_2$ and $P_3$; and the third roller platen 32Y is provided with a third spring-biasing unit 34Y so as to be elastically pressed against the second thermal head 30Y at a pressure between the critical compacting-pressures $P_1$ and $P_2$.

Note, the roller platens 32C, 32M and 32Y are arranged in sequence so that the respective pressures, exerted by the platens 32C, 32M and 32Y on the line thermal heads 30C, 30M and 30Y, decrease in the movement direction of the image-forming substrate 10.

In FIG. 6, reference 36 indicates a control circuit board for controlling a printing operation of the color printer, and reference 38 indicates an electrical main power source for electrically energizing the control circuit board 36.

With the arrangement of the above-mentioned line printer, for example, when one of the electric resistance elements $R_{cn}$ is heated to a temperature in the range between the glass-transition temperatures $T_1$ and $T_2$, a cyan dot, having a dot size (diameter) of about 50 $\mu$m to about 100 $\mu$m, is developed on the microcapsule layer 14 of the image-forming sheet 10, because only the cyan microcapsules 18C are broken and squashed at a dot area heated by the resistance element ($R_{cn}$) concerned. Of course, although a plurality of cyan, magenta and yellow microcapsules 18C, 18M and 18Y are uniformly included in a dot area (50 $\mu$m to 100 $\mu$m) to be developed on the microcapsule layer 14, it is possible to break and squash only the cyan microcapsules 18C, because the heating temperature is within the range between the glass-transition temperatures $T_1$ and $T_2$.

Although the heating temperature is within the range between the glass-transition temperatures $T_1$ and $T_2$, all of the cyan microcapsules 18C, included in the dot area to be developed, are not necessarily broken and squashed, because the electric resistance element ($R_{cn}$) concerned cannot be uniformly heated by the electrical energization thereof, so that the dot area to be developed also cannot be uniformly heated.

Figure 8:
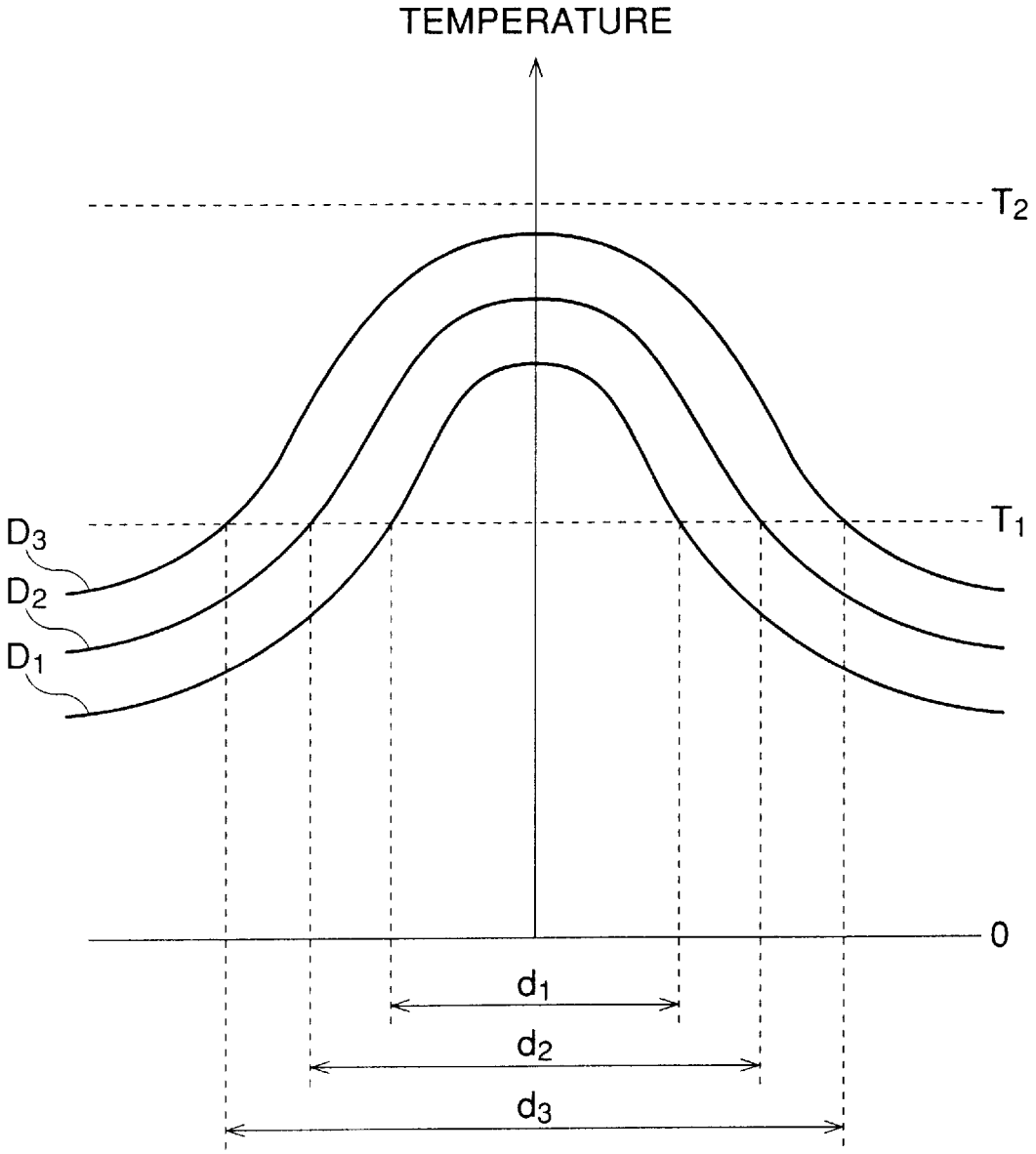
FIG. 8 is a graph showing a temperature distribution of a dot area on the layer of microcapsules, heated by one of electric resistance elements of the thermal head.

FIG. 8 shows a temperature distribution of a dot area heated by one of the electric resistance elements $R_{cn}$. In this graph, reference $D_1$ represents a temperature distribution over the dot area when the resistance element ($R_{cn}$) concerned is electrically energized for a period of time $t_1$; reference $D_2$ represents a temperature distribution over the dot area when the resistance element ($R_{cn}$) concerned is electrically energized for a period of time $t_2$ longer than the time ti; and reference $D_3$ represents a temperature distribution over the dot area when the resistance element ($R_{cn}$) concerned is electrically energized for a period of time $t_3$ longer than the time $t_2$. As is apparent from the characteristics of these temperature distributions, when the resistance element ($R_{cn}$) concerned is electrically energized for a given period of time, the temperature of the dot area is a maximum at the center, decreasing toward the periphery thereof.

As shown in the graph of FIG. 8, when the duration of the electrical energization is for time $t_1$, a central zone of the dot area, having a diameter of $d_1$, is heated beyond the glass-transition temperature $T_1$, and thus only the cyan microcapsules, included in the central zone having the diameter of $d_1$, are broken and squashed, so that the central zone, having the diameter of $d_1$, is obtained as a developed cyan dot.

When the duration of the electrical energization is for time $t_2$, a central zone of the dot area, having a diameter of $d_2$ larger than the diameter of $d_1$, is heated beyond the glass-transition temperature $T_1$, and thus only the cyan microcapsules, included in the central zone having the diameter of $d_2$, are broken and squashed, so that the central zone, having the diameter of $d_2$, is obtained as a developed cyan dot.

When the duration of the electrical energization is for time $t_3$, a central zone of the dot area, having a diameter of $d_3$ larger than the diameter of $d_2$, is heated beyond the glass-transition temperature $T_1$, and thus only the cyan microcapsules, included in the central zone having the diameter of $d_3$, are broken and squashed, so that the central zone, having the diameter of $d_3$, is obtained as a developed cyan dot. Note, the diameter of $d_3$ substantially coincides with a maximum dot size obtainable by the resistance element ($R_{cn}$) concerned.

In short, by suitably regulating the period of electrical energization of each of the resistance elements $R_{cn}$, it is possible to obtain one of the differently-sized cyan dots having the respective diameters of $d_1$, $d_2$ and $d_3$, resulting in the resistance element ($R_{cn}$) concerned being able to develop a cyan dot of variable density (gradation).

Of course, the same is true for the microcapsules 18M and the microcapsules 18Y included in the microcapsule layer 14 of the image-forming substrate. Namely, by suitably regulating the period of electrical energization of each of the resistance elements $R_{mn}$, it is possible to obtain one of the differently-sized magenta dots having the respective diameters of $d_1$, $d_2$ and $d_3$, resulting in the resistance element ($R_{mn}$) concerned being able to develop a cyan dot of variable density (gradation), and, by suitably regulating the period electrical energization of each of the resistance elements $R_{yn}$, it is possible to obtain one of the differently-sized yellow dots having the respective diameters of $d_1$, $d_2$ and $d_3$, resulting in the resistance element ($R_{yn}$) concerned being able to develop a cyan dot of variable density (gradation).

Figure 9:
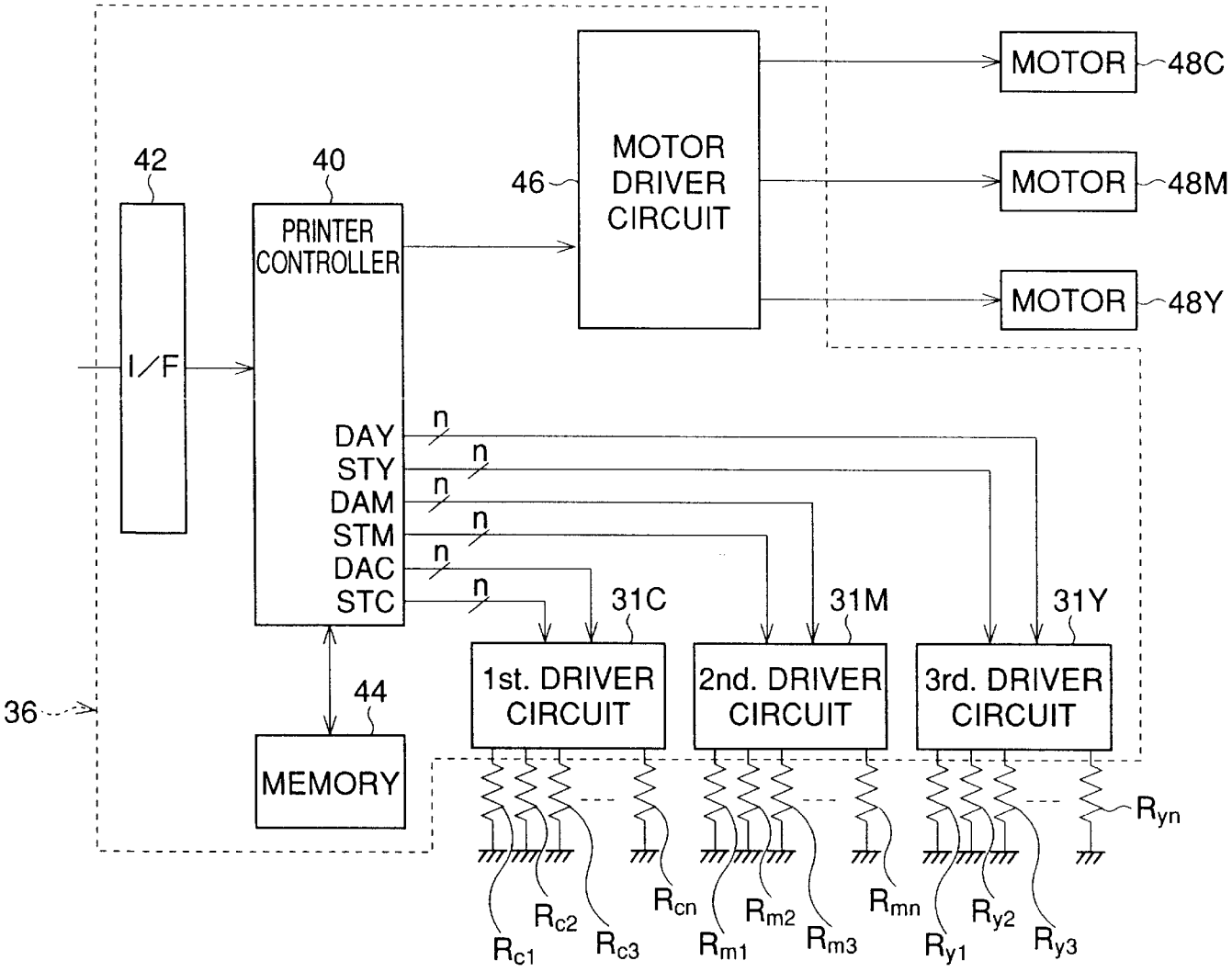
FIG. 9 is a schematic block diagram of a control circuit board of the color printer shown in FIG. 6.

FIG. 9 shows a schematic block diagram of the control circuit board 36. As shown in this drawing, the control circuit board 36 comprises a printer controller 40 including a microcomputer. The printer controller 40 receives a series of digital color image-pixel signals from a personal computer or a word processor (not shown) through an interface circuit (I/F) 42, with each of the digital color image-pixel signals carrying a digital 2-bit gradation-signal. The received digital color image-pixel signals (i.e., digital cyan image-pixel signals carrying 2-bit digital gradation signals, digital magenta image-pixel signals carrying 2-bit digital gradation signals, and digital yellow image-pixel signals carrying 2-bit digital gradation signals) are once stored in a memory 44.

Also, the control circuit board 36 is provided with a motor driver circuit 46 for driving three electric motors 48C, 48M and 48Y, which are used to rotationally drive the roller platens 32C, 32M and 32Y, respectively. In this embodiment of the color printer, each of the motors 48C, 48M and 48Y is a stepping motor, which is driven in accordance with a series of drive pulses outputted from the motor driver circuit 46, the outputting of drive pulses from the motor driver circuit 46 to the motors 48C, 48M and 48Y being controlled by the printer controller 40.

During a printing operation, the respective roller platens 32C, 32M and 32Y are intermittently rotated in a counter-clockwise direction (FIG. 6) by the motors 48C, 48M and 48Y, with a same peripheral speed. Accordingly, the image-forming sheet 10, introduced through the entrance opening 22, intermittently moves toward the exit opening 24 along the path 26. Thus, the image-forming sheet 10 is subjected to pressure ranging between the critical breaking-pressure $P_3$ and the upper limit pressure $P_{UL}$ when passing between the first line thermal head 30C and the first roller platen 32C; to pressure ranging between the critical breaking-pressures $P_2$ and $P_3$ when passing between the second line thermal head 30M and the second roller platen 32M; and to pressure ranging between the critical breaking-pressures $P_1$ and $P_2$ when passing between the third line thermal head 30Y and the third roller platen 32Y.

Note, in this embodiment of the color printer, the introduction of the image-forming sheet 10 into the entrance opening 22 of the printer is carried out such that the transparent protective film sheet 16 of the image-forming sheet 10 comes into contact with the thermal heads 30C, 30M and 30Y.

As is apparent from FIG. 9, the respective driver circuits 31C, 31M and 31Y for the line thermal heads 30C, 30M and 30Y are controlled by the printer controller 40. Namely, the driver circuits 31C, 31M and 31Y are controlled by n sets of strobe signals "STC" and control signals "DAC", n sets of strobe signals "STM" and control signals "DAM", and n sets of strobe signals "STY" and control signals "DAY", respectively, outputted from the printer controller 40, thereby carrying out the selective energization of the resistance elements $R_{c1}$ to $R_{cn}$, the selective energization of the resistance elements $R_{m1}$ to $R_{mn}$ and the selective energization of the resistance elements $R_{y1}$, to $R_{yn}$, as stated in detail below.

Figure 10:
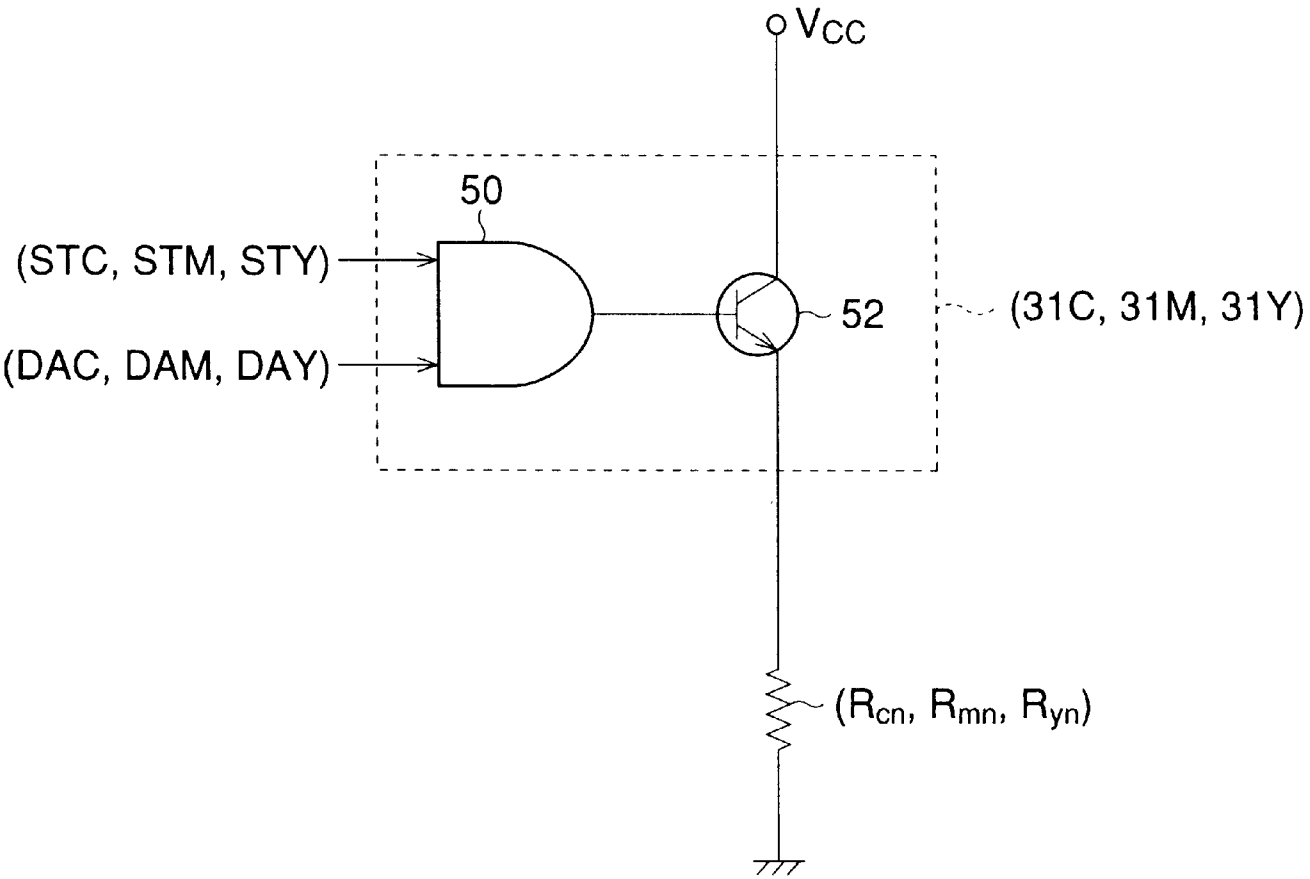
FIG. 10 is a partial block diagram representatively showing a set of an AND-gate circuit and a transistor included in each of the thermal head driver circuits of FIG. 9.

In each driver circuit (31C, 31M, 31Y), n sets of AND-gate circuits and transistors are provided with respect to the respective electric resistance elements $R_{cn}$, $R_{mn}$ and $R_{yn}$. With reference to FIG. 10, an AND-gate circuit and a transistor in one set are representatively shown and indicated by references 50 and 52, respectively. A set of a strobe signal (STC, STM or STY) and a control signal (DAC, DAM or DAY) is inputted from the printer controller 40 to two input terminals of the AND-gate circuit 50. A base of the transistor 52 is connected to an output terminal of the AND-gate circuit 50; a corrector of the transistor 52 is connected to an electric power source ($V_{cc}$); and an emitter of the transistor 52 is connected to a corresponding electric resistance element ($R_{cn}$, $R_{mn}$, $R_{yn}$).

Figures 11, 12:
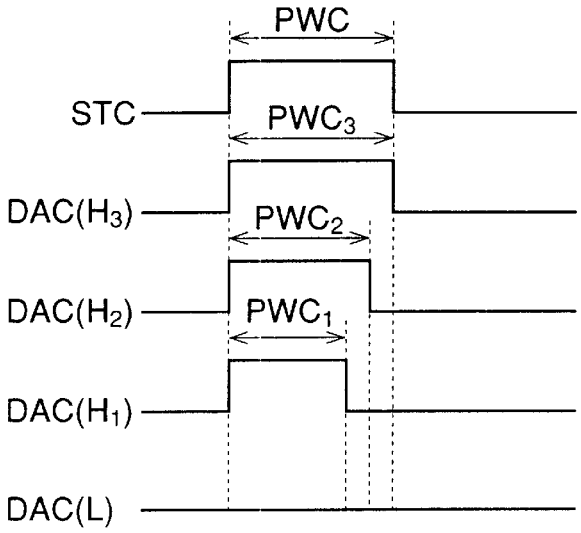
FIG. 11 is a timing chart showing a strobe signal and a control signal for electronically actuating one of the thermal head driver circuits for producing a cyan dot on the image-forming substrate of FIG. 1.
FIG. 12 is a table showing a relationship between a 2-bit gradation signal carried by each digital cyan, magenta and yellow image-pixel signal, and a pulse width of a control signal outputted from a printer controller to a corresponding AND-gate circuit.

When the AND-gate circuit 50, as shown in FIG. 10, is one included in the first driver circuit 31C, a set of a strobe signal "STC" and a control signal "DAC" is outputted from the printer controller 40, and is then inputted to the input terminals of the AND-gate circuit 50. As shown in a timing chart of FIG. 11, the strobe signal "STC" has a pulse width "PWC", and the control signal "DAC" is varied in accordance with binary values of a digital cyan image-pixel signal and a 2-bit digital gradation signal carried thereby, as shown in TABLE I of FIG. 12.

Namely, when the digital cyan image-pixel signal has a value "0", and when the 2-bit digital gradation signal has 2-bit data [00], the control signal "DAC" is maintained at a low-level under control of the printer controller 40. When the digital cyan image-pixel signal has a value "1", the control signal "DAC" is outputted as a high-level pulse from the printer controller 40, and a pulse width of the high-level pulse is varied in accordance with a value of the 2-bit digital gradation signal concerned.

In particular, when the 2-bit digital gradation signal has 2-bit data [11], the high-level pulse of the control signal "DAC" has the same pulse width "$PWC_3$" a as the pulse width "PWC" of the strobe signal "STC", and a corresponding one of the electric resistance elements $R_{cn}$ is electrically energized during a period corresponding to the pulse width "$PWC_3$" of the high-level pulse of the control signal "DAC", which is equal to the electrical energization time $t_3$, whereby a cyan dot, having the maximum size of $d_3$, is developed on the microcapsule layer 14 of the image-forming sheet 10.

When the 2-bit digital gradation signal has 2-bit data [10], the high-level pulse of the control signal "DAC" has a pulse width "$PWC_2$", shorter than the pulse width "$PWC_3$", and a corresponding one of the electric resistance elements $R_{cn}$ is electrically energized during a period corresponding to the pulse width "$PWC_2$" of the high-level pulse of the control signal "DAC", which is equal to the electrical energization time $t_2$, whereby a cyan dot, having the intermediate size of $d_2$, is developed on the microcapsule layer 14 of the image-forming sheet 10.

When the 2-bit digital gradation signal has 2-bit data [01], the high-level pulse of the control signal "DAC" has a pulse width "$PWC_1$", shorter than the pulse width "$PWC_2$", and a corresponding one of the electric resistance elements $R_{cn}$ is electrically energized during a period corresponding to the pulse width "$PWC_1$" of the high-level pulse of the control signal "DAC", which is equal to the electrical energization time $t_1$, whereby a cyan dot, having the minimum size of $d_1$, is developed on the microcapsule layer 14 of the image-forming sheet 10.

Accordingly, a cyan density of the developed cyan dot varies in accordance with the electrical energization time ($t_1$, $t_2$, $t_3$), thereby obtaining a variation in density (gradation) of the cyan dot. Of course, as the electrical energization time ($t_1$, $t_2$, $t_3$) increases, the cyan density of the cyan dot becomes higher.

Figure 13:
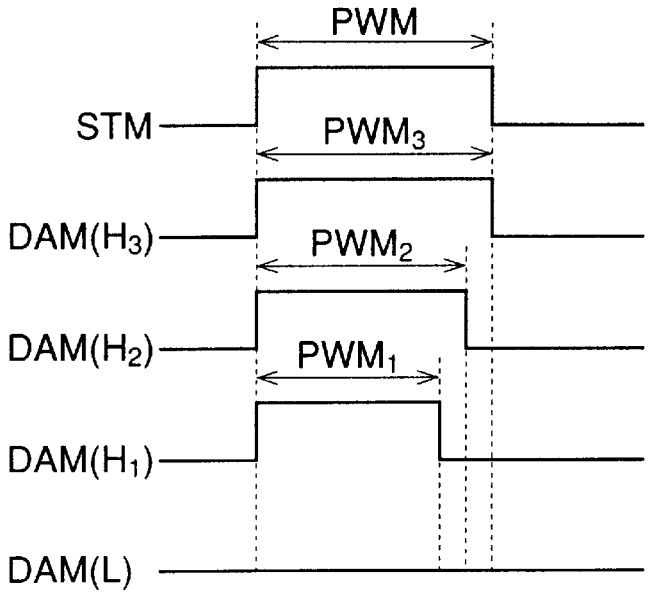
FIG. 13 is a timing chart showing a strobe signal and a control signal for electronically actuating another one of the thermal head driver circuits for producing a magenta dot on the image-forming substrate of FIG. 1.

Similarly, when the AND-gate circuit 50, as shown in FIG. 10, is one included in the second driver circuit 31M, a set of a strobe signal "STM" and a control signal "DAM" is outputted from the printer controller 40, and is then inputted to the input terminals of the AND-gate circuit 50. As shown in a timing chart of FIG. 13, the strobe signal "STM" has a pulse width "PWM", longer than the pulse width of the strobe signal "STC", and the control signal "DAM" is varied in accordance with binary values of a digital magenta image-pixel signal and a 2-bit digital gradation signal carried thereby, as shown in TABLE I of FIG. 12. Namely, an electrical energization of each electric resistance element $R_{mn}$ is controlled in substantially the same manner as the electric resistance element $R_{cn}$, and thus it is possible to obtain a variation in density (gradation) of the magenta dot.

Figure 14:
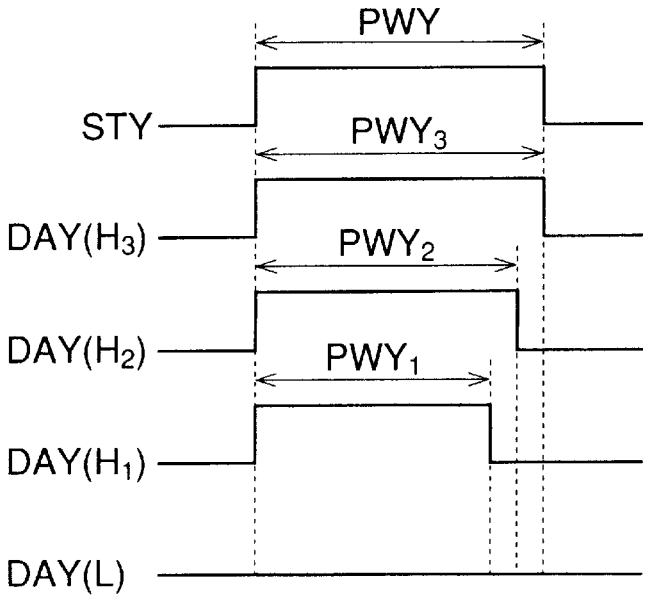
FIG. 14 is a timing chart showing a strobe signal and a control signal for electronically actuating the remaining thermal head driver circuit for producing a yellow dot on the image-forming substrate of FIG. 1.

Further, when the AND-gate circuit 50, as shown in FIG. 10, is one included in the third driver circuit 31Y, a set of a strobe signal "STY" and a control signal "DAY" is outputted from the printer controller 40, and is then inputted to the input terminals of the AND-gate circuit 50. As shown in a timing chart of FIG. 14, the strobe signal "STY" has a pulse width "PWY", longer than the pulse width of the strobe signal "STM", and the control signal "DAY" is varied in accordance with binary values of a digital yellow image-pixel signal and a digital 2-bit gradation signal carried thereby, as shown in TABLE I of FIG. 12. Namely, an electrical energization of each electric resistance element $R_{yn}$ is controlled in substantially the same manner as the electric resistance element $R_{cn}$, and thus it is possible to obtain a variation in density (gradation) of the yellow dot.

Of course, according to the aforesaid color printer, it is possible to form a color image, having a color gradation, on the image-forming sheet 10 on the basis of a plurality of three-primary color dots obtained by selectively heating the electric resistance elements ($R_{c1}$, to $R_{cn}$; $R_{m1}$, to $R_{mn}$; and $R_{y1}$ to $R_{yn}$) in accordance with three-primary color digital image-pixel signals and the 2-bit digital gradation signals carried thereby. Namely, a certain dot of the color image, formed on the image-forming sheet 10, is obtained by a combination of cyan, magenta and yellow dots developed by corresponding electric resistance elements $R_{cn}$, $R_{mn}$ and $R_{yn}$.

Figure 15:
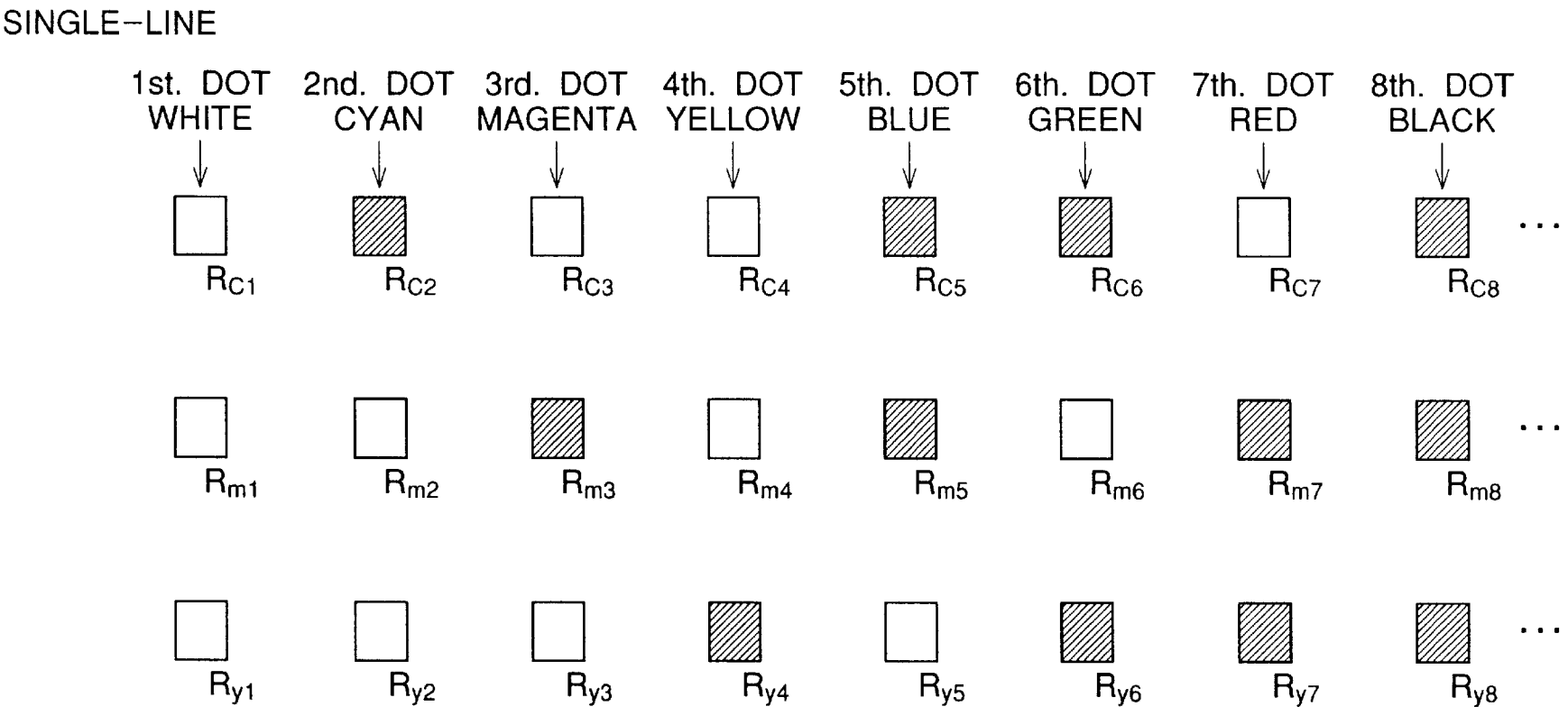
FIG. 15 is a conceptual view showing, by way of example, the production of color dots of a color image in the color printer of FIG. 6.

In particular, for example, as conceptually shown by FIG. 15, in a single-line of dots, forming a part of the color image, if a first dot is white, none of the electric resistance elements $R_{c1}$, $R_{m1}$, and $R_{y1}$ are heated. If a second dot is cyan, only the electric resistance element $R_{c2}$ is heated, and the remaining electric resistance elements $R_{m2}$ and $R_{y2}$ are not heated. If a third dot is magenta, only the resistance element $R_{m3}$ is heated, and the remaining resistance elements $R_{c3}$ and $R_{y3}$ are not heated. Similarly, if a fourth dot is yellow, only the resistance element $R_{y4}$ is heated, and the remaining resistance elements $R_{c4}$ and $R_{m4}$ are not heated.

Further, as shown in FIG. 15, if a fifth dot is blue, the electric resistance elements $R_{c5}$ and $R_{m5}$ are heated, and the remaining electric resistance element $R_{y5}$ is not heated. If a sixth dot is green, the resistance elements $R_{c6}$ and $R_{y6}$ are heated, and the remaining resistance element $R_{m6}$ is not heated. If a seventh dot is red, the resistance elements $R_{m7}$ and $R_{y7}$ are heated, and the remaining resistance element $R_{c7}$ is not heated. If an eighth dot is black, all of the resistance elements $R_{c8}$, $R_{m8}$ and $R_{y8}$ are heated. Note, of course, each of the developed color dots can exhibit a color gradation in accordance with a corresponding 2-bit gradation signal.

In the above-mentioned embodiment of the color printer, although a pulse width of the control signal ("DAC", "DAM", "DAY") is varied to regulate an electrical energization of an electric resistance element ($R_{cn}$, $R_{mn}$ and $R_{yn}$), thereby obtaining a variation in density (gradation) of a developed color dot, a number of times that the control signal ("DAC", "DAM", "DAY") is outputted as a pulse may be controlled in accordance with binary values of a digital color image-pixel signal and a 2-bit digital gradation signal carried thereby, so as to obtain the variation in density (gradation) of the developed color dot.

For example, an electrical energization of an electric resistance element $R_{cn}$ is regulated by controlling a number of times that a control signal "DAC" is outputted as a pulse from the printer controller 40 to the input terminals of a corresponding AND-gate circuit 50, in accordance with binary values of a digital cyan image-pixel signal and a 2-bit digital gradation signal carried thereby.

Figures 16, 17:
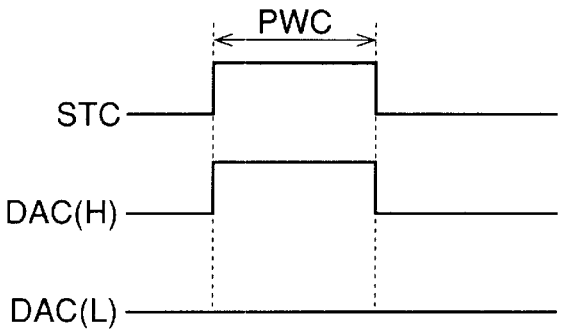
FIG. 16 is a timing chart showing a strobe signal and a control signal for electronically actuating one of the thermal head driver circuits for producing a cyan dot on the image-forming substrate of FIG. 1.
FIG. 17 is a table showing a relationship between a 2-bit gradation signal carried by each digital cyan, magenta and yellow image-pixel signal, and a number of times that a control signal is outputted from a printer controller to a corresponding AND-gate circuit.

In particular, when the digital cyan image-pixel signal has a value "0", the control signal "DAC" is maintained at a low-level under control of the printer controller 40, as shown in a timing chart of FIG. 16. When the digital cyan image-pixel signal has a value "1", the control signal "DAC" is outputted as a high-level pulse from the printer controller 40, and the high-level pulse has the same pulse width as a strobe signal "PWC", as shown in the timing chart of FIG. 16.

Also, when the digital cyan image-pixel signal has the value "1", a number of times that the control signal "DAC"

is outputted as the high-level pulse from the printer controller 40 is controlled in accordance with the 2-bit digital gradation signal, as shown in TABLE II of FIG. 17.

For example, when the 2-bit digital gradation signal has 2-bit data [01], the control signal "DAC" is only once outputted as the high-level pulse, together with the strobe signal "STC", to the input terminals of a corresponding AND-gate circuit 50. Thus, a corresponding electric resistance element ($R_{cn}$) is electrically energized during a period corresponding to the pulse width "PWC" of the control signal "DAC", corresponding to the electrical energization time $t_1$, whereby a cyan dot area to be heated by the electric resistance element ($R_{cn}$) exhibits a temperature distribution, as indicated by reference $D_1$ in FIG. 8. Accordingly, a cyan dot, having a minimum size ($d_1$), is developed on the microcapsule layer 14 of the image-forming sheet 10.

When the 2-bit digital gradation signal has 2-bit data [10], the control signal "DAC" is twice outputted as the high-level pulse, together with the strobe signal "STC", to the input terminals of the AND-gate circuit 50 over a suitable interval of time. Thus, the electric resistance element $R_{cn}$ is further electrically energized, whereby a cyan dot area to be heated by the electric resistance element ($R_{cn}$) exhibits a temperature distribution, as indicated by reference $D_2$ in FIG. 8. Accordingly, a cyan dot, having an intermediate size ($d_2$), is developed on the microcapsule layer 14 of the image-forming sheet 10.

When the 2-bit digital gradation signal has 2-bit data [11], the control signal "DAC" is thrice outputted as the high-level pulse, together with the strobe signal "STC", to the input terminals of the AND-gate circuit 50 over a suitable interval of time. Thus, the electric resistance element $R_{cn}$ is yet further electrically energized, whereby a cyan dot area to be heated by the electric resistance element ($R_{cn}$) exhibits a temperature distribution, as indicated by reference $D_3$ in FIG. 8. Accordingly, a cyan dot, having a maximum size ($d_3$), is developed on the microcapsule layer 14 of the image-forming sheet 10.

In short, a variation in density (gradation) of the cyan dot can be obtained through a regulator that regulates the electrical energization of each electric resistance element $R_{cn}$ by controlling the number of times that the control signal "DAC" is outputted as the high-level pulse.

Figure 18:
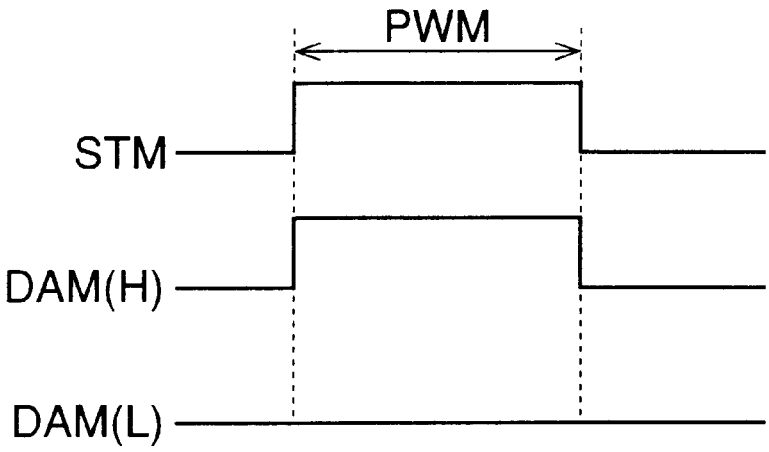
FIG. 18 is a timing chart showing a strobe signal and a control signal for electronically actuating another one of the thermal head driver circuits for producing a magenta dot on the image-forming substrate of FIG. 1.

Similarly, when the digital magenta image-pixel signal has a value "0", the control signal "DAM" is maintained at a low-level under control of the printer controller 40, as shown in a timing chart of FIG. 18 When the digital magenta image-pixel signal has a value "1", the control signal "DAM" is outputted as a high-level pulse from the printer controller 40, and the high-level pulse has the same pulse width as a strobe signal "STM", as shown in the timing chart of FIG. 18. Note, the pulse width of the strobe signal "STM" is longer than that of the strobe signal "STC".

Also, when the digital magenta image-pixel signal has the value "1", a number of times that the control signal "DAM" is outputted as the high-level pulse from the printer controller 40 is controlled in accordance with the 2-bit digital gradation signal, as shown in TABLE II of FIG. 17. Thus, a variation in density (gradation) of the magenta dot can also be obtained through regulation of the electrical energization of each electric resistance element $R_{mn}$ by controlling the number of times that the control signal "DAM" is outputted as the high-level pulse.

Figure 19:
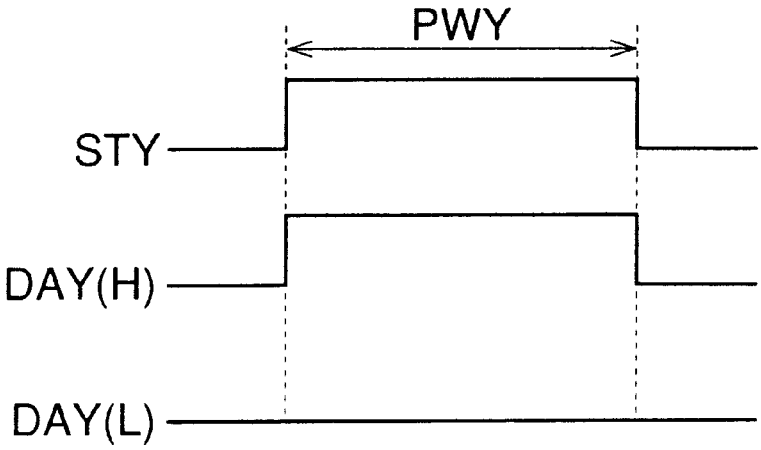
FIG. 19 is a timing chart showing a strobe signal and a control signal for electronically actuating another one of the thermal head driver circuits for producing a yellow dot on the image-forming substrate of FIG. 1.

Similarly, when the digital yellow image-pixel signal has a value "0", the control signal "DAY" is maintained at a low-level under control of the printer controller 40, as shown in a timing chart of FIG. 19. When the digital yellow image-pixel signal has a value "1", the control signal "DAY" is outputted as a high-level pulse from the printer controller 40, and the high-level pulse has the same pulse width as a strobe signal "STY", as shown in the timing chart of FIG. 19. Note, the pulse width of the strobe signal "STY" is longer than that of the strobe signal "STM".

Also, when the digital yellow image-pixel signal has the value "1", a number of times that the control signal "DAY" is outputted as the high-level pulse from the printer controller 40 is controlled in accordance with the 2-bit digital gradation signal, as shown in TABLE II of FIG. 17. Thus, a variation in density (gradation) of the yellow dot can be obtained through regulation of the electrical energization of each electric resistance element $R_{yn}$ by controlling the number of times that the control signal "DAY" is outputted as the high-level pulse.

Figure 20:
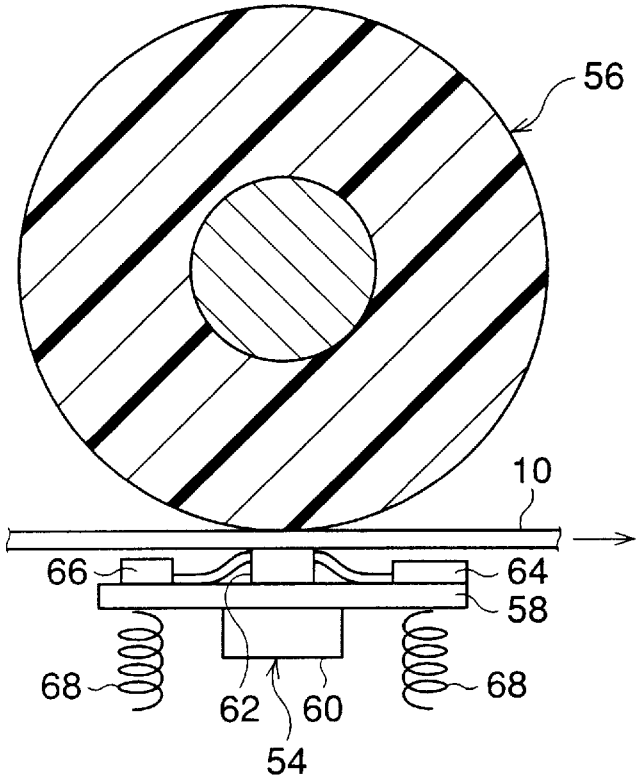
FIG. 20 is a schematic cross sectional view of a second embodiment of a color printer, according to the present invention, for forming a color image on the image-forming substrate shown in FIG. 1.
Figure 21:
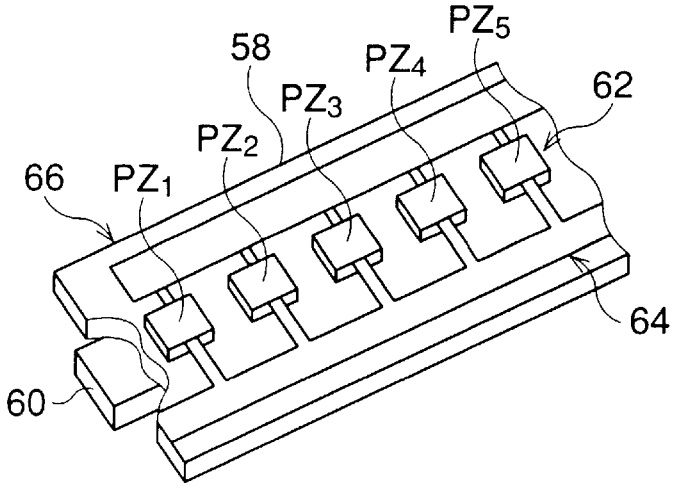
FIG. 21 is a partial perspective view showing a thermal head having an array of piezoelectric elements, used in the color printer shown in FIG. 21.

FIGS. 20 and 21 show a second embodiment of a color printer, which may be used in the image-forming system according to the present invention, and which is constituted as a line printer so as to form a color image on the image-forming sheet 10.

The color printer comprises a thermal head 54 associated with a roller platen 56, which may be formed of a suitable hard rubber material, and which is intermittently rotated in a counterclockwise direction (FIG. 20) such that the image-forming sheet 10 is intermittently moved between the thermal head 54 and the roller platen 56 in a direction indicated by an arrow shown in FIG. 20. The thermal head 54 is constituted as a line thermal head perpendicularly extended with respect to a direction of movement of the image-forming sheet 10.

As best shown in FIG. 21, the thermal head 54 includes an elongated base plate 58 formed of a ceramic material, an elongated electric heater 60 securely attached to a lower surface of the base plate 58 and longitudinally coextending with the base plate 58, and an array of piezoelectric elements 62 aligned on an upper surface of the base plate 58 along the elongated electric heater 60. Note, the piezoelectric array 62 comprises n piezoelectric elements $PZ_n$ (where n=1, 2, 3, 4, 5, . . . ), with only a part of the n piezoelectric elements, indicated by references $PZ_1$ to $PZ_5$, respectively, being illustrated in FIG. 21. Note, the ceramic base plate 58 is sufficiently thin so that the piezoelectric elements $PZ_n$ is immediately heated to a predetermined temperature when the electric heater 60 is electrically energized.

The base plate 58 is formed with two wiring board patterns 64 and 66 arranged at sides of the piezoelectric array 62, and each of the piezoelectric elements $PZ_n$ is electrically connected to the wiring board patterns 64 and 66 through two respective corresponding electrode elements extended therefrom, as shown in FIG. 21. The base plate 58 is resiliently biased towards the roller platen 56 by compressed coil springs 68, as shown in FIG. 20, such that the piezoelectric array 62 is resiliently pressed against the roller platen 46 with a given resilient force.

Figure 22:
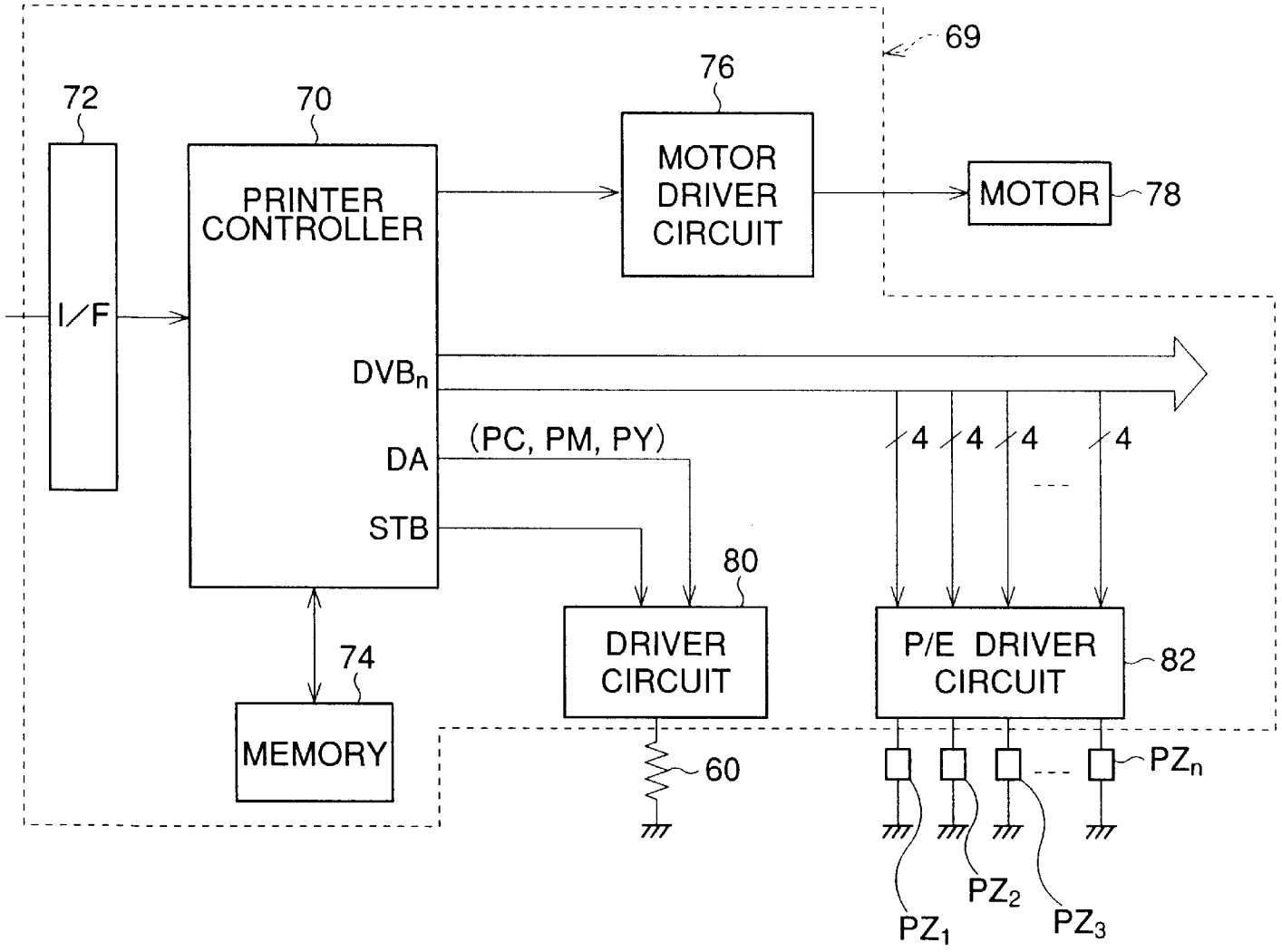
FIG. 22 is a schematic block diagram of a control circuit board of the second embodiment of the color printer according to the present invention.

FIG. 22 shows a schematic block diagram of a control circuit board of the color printer shown in FIGS. 22 and 21. As shown in this drawing, the control circuit board, indicated by reference 69, comprises a printer controller 70 including a microcomputer, which receives digital color image-pixel signals from a personal computer or a word processor (not shown) through an interface circuit (I/F) 72, and the received digital color image-pixel signals, i.e. digital cyan image-pixel signals, digital magenta image-pixel signals and digital yellow image-pixel signals, are stored in a memory 74.

Also, the control circuit board 69 is provided with a motor driver circuit 76 for driving an electric motor 78, which is used to intermittently rotate the roller platen 56 (FIG. 20). The motor 78 is a stepping motor, which is driven in accordance with a series of drive pulses outputted from the motor driver circuit 76, and the outputting of drive pulses from the motor driver circuit 76 to the motor 78 is controlled by the printer controller 70.

As shown in FIG. 22, the control circuit board 69 is provided with a driver circuit 80 for electrically energizing the electric heater 60 of the line thermal head 54 under control of the printer controller 70. Namely, the driver circuit 80 is controlled by a strobe signal "STB" and a control signal "DA, outputted from the printer controller 70, as stated in detail hereinafter. Also, the control circuit board 69 is provided with a P/E driver circuit 82 for selectively and electrically energizing the piezoelectric elements $PZ_1$ to $PZ_n$ of the line thermal head 54 under control of the printer controller 70. Namely, the P/E driver circuit 82 is controlled by n 4-bit control signals "$DVB_n$", outputted from the printer controller 70, thereby carrying out the selective energization of the piezoelectric elements $PZ_1$ to $PZ_n$, as stated in detail hereinafter.

Figure 23:
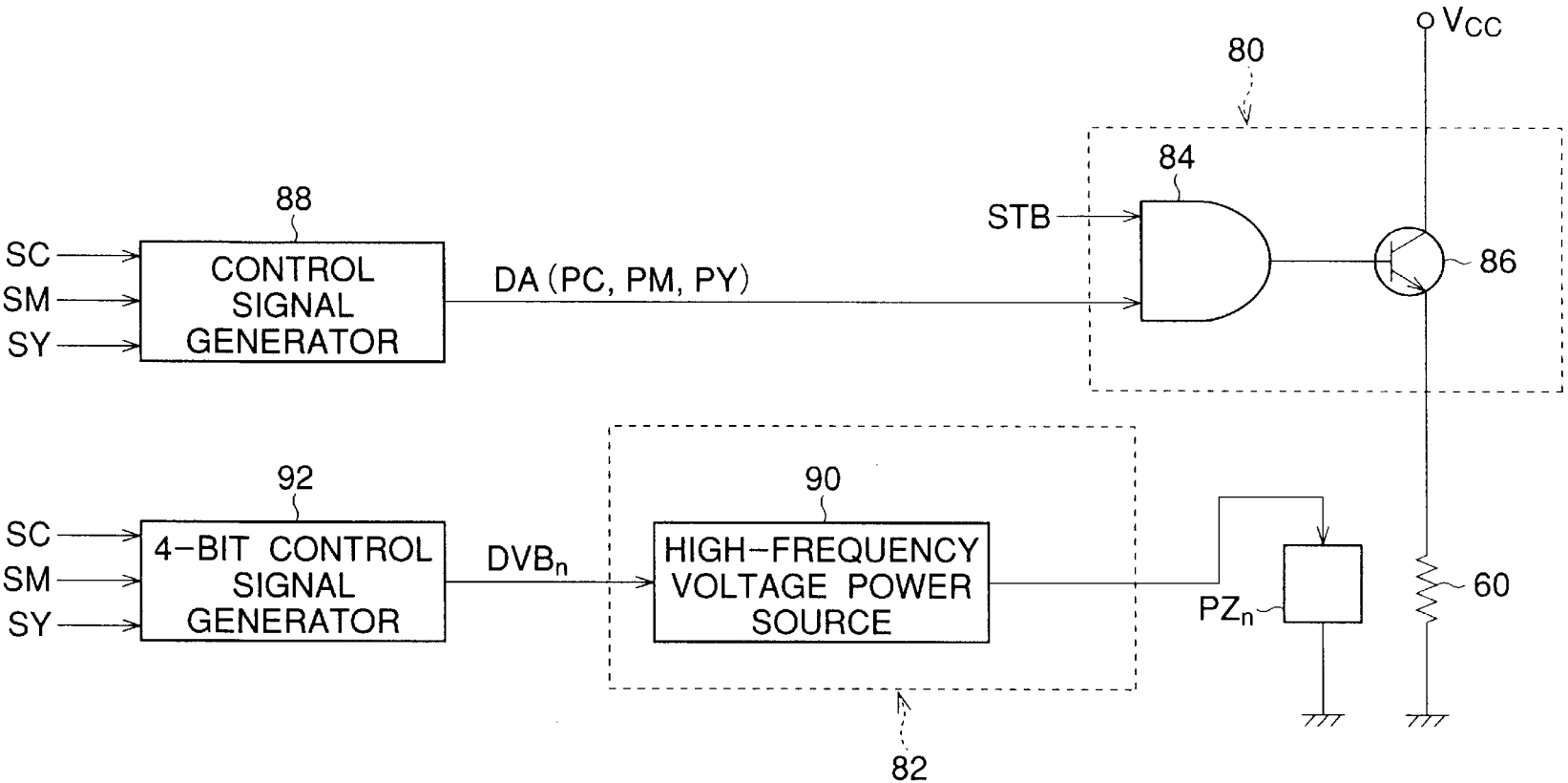
FIG. 23 is a partial block diagram representatively showing a set of an AND-gate circuit and a transistor, included in a thermal head driver circuit of FIG. 22, and a high-frequency voltage power source, included in a P/E driver circuit of FIG. 22, for successively developing the cyan, magenta and yellow dots on the image-forming substrate shown in FIG. 1.

As shown in FIG. 23, the driver circuit 80 is provided with an AND-gate circuit 84 and a transistor 86, and the strobe signal "STB" and the control signal "DA" are inputted from the printer controller 70 to two input terminals of the AND-gate circuit 84. Note, the control signal "DA" is generated by a control signal generator 88, included in the printer controller 70, in a manner as stated hereinafter. A base of the transistor 86 is connected to an output terminal of the AND-gate circuit 84; a collector of the transistor 86 is connected to an electric power source ($V_{cc}$); and an emitter of the transistor 86 is connected to the electric heater 60.

On the other hand, in the P/E driver circuit 82, n high-frequency voltage sources are provided, each corresponding to a respective piezoelectric element ($PZ_n$), and one of the n high-frequency voltage sources is representatively shown and indicated by reference 90 in FIG. 23. The high-frequency voltage source 90 selectively produces one of plural high-frequency voltages ($f_{C1}$, $f_{C2}$ and $f_{C3}$; $f_{M1}$, $f_{M2}$ and $f_{M3}$; and $f_{Y1}$, $f_{Y2}$ and $f_{Y3}$) in accordance with 4-bit data of a 4-bit control signal "$DVB_n$" inputted thereto, and the produced high-frequency voltage is applied to a corresponding piezoelectric element "$PZ_n$". Note, the 4-bit control signal "$DVB_n$" is generated by a 4-bit control signal generator 92, included in the printer controller 70, in a manner as stated hereinafter.

When a piezoelectric element ($PZ_n$) is energized by the high-frequency voltage $f_{C1}$, the piezoelectric element ($Z_n$) concerned exerts a pressure $P_{C1}$ on the image-forming sheet 10. When a piezoelectric element ($PZ_n$) is energized by the high-frequency voltage $f_{C2}$ the piezoelectric element ($Z_n$) concerned exerts a pressure $P_{C2}$ on the image-forming sheet 10. When a piezoelectric element ($PZ_n$) is energized by the high-frequency voltage $f_{C3}$, the piezoelectric element ($PZ_n$) concerned exerts a pressure $P_{C3}$ on the image-forming sheet 10. The pressures $P_{C1}$, $P_{C2}$ and $P_{C3}$ are included in the range between the critical breaking-pressure $P_3$ and the upper limit pressure $P_{UL}$ (FIG. 3), and have the following relationship:

$P_{C1}<P_{C2}<P_{C3}$

When a piezoelectric element ($PZ_n$) is energized by the high-frequency voltage $f_{M1}$, the piezoelectric element ($PZ_n$) concerned exerts a pressure $P_{M1}$ on the image-forming sheet 10. When a piezoelectric element ($PZ_n$) is energized by the high-frequency voltage $f_{C2}$, the piezoelectric element ($PZ_n$) concerned exerts a pressure $P_{M2}$ on the image-forming sheet 10. When a piezoelectric element ($PZ_n$) is energized by the high-frequency voltage $f_{M3}$, the piezoelectric element ($PZ_n$) concerned exerts a pressure $P_{M3}$ on the image-forming sheet 10. The pressures $P_{M1}$, $P_{M2}$ and $P_{M3}$ are included in the range between the critical breaking-pressures $P_2$ and $P_3$ (FIG. 3), and have the following relationship:

$P_{M1}<P_{M2}<P_{M3}$

When a piezoelectric element ($PZ_n$) is energized by the high-frequency voltage $f_{Y1}$, the piezoelectric element ($PZ_n$) concerned exerts a pressure $P_{Y1}$ on the image-forming sheet 10. When a piezoelectric element ($PZ_n$) is energized by the high-frequency voltage $f_{Y2}$, the piezoelectric element ($PZ_n$) concerned exerts a pressure $P_{Y2}$ on the image-forming sheet 10. When a piezoelectric element ($PZ_n$) is energized by the high-frequency voltage $f_{Y3}$, the piezoelectric element ($PZ_n$) concerned exerts a pressure $P_{Y3}$ on the image-forming sheet 10. The pressures $P_{Y1}$, $P_{Y2}$ and $P_{Y3}$ are included in the range between the critical breaking-pressures $P_1$ and $P_2$ (FIG. 3), and have the following relationship:

$P_{Y1}<P_{Y2}<P_{Y3}$

During a printing operation of the color printer shown in FIGS. 20 and 21, a single-line of color image is formed on the image-forming sheet 10 by successively developing cyan dots, magenta dots and yellow dots with the n piezoelectric elements $PZ_n$ in accordance with a single-line of n digital cyan image-pixel signals "SC", a single-line of n digital magenta image-pixel signals "SM", and a single-line n digital yellow signals "SY", respectively. Note, each of the digital cyan image-pixel signal "SC" carries a 2-bit gradation signal "GSC"; each of the digital magenta image-pixel signal "SM" carries a 2-bit gradation signal "GSM"; and each of the digital yellow image-pixel signal "SY" carries a 2-bit gradation signal "GSY".

Figure 24:
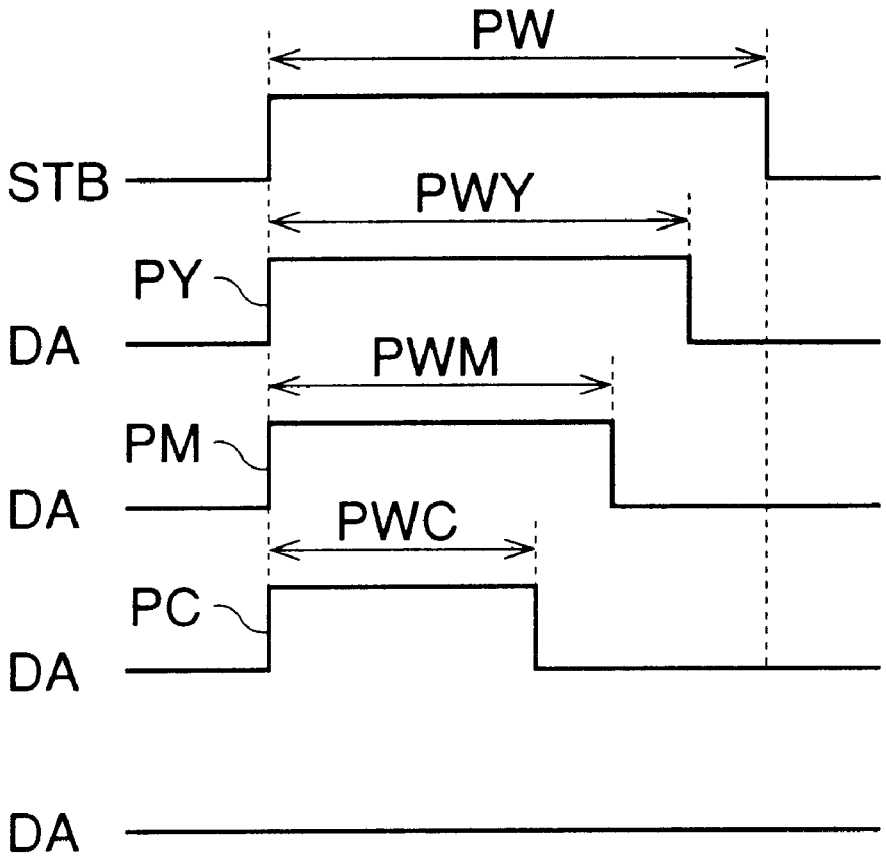
FIG. 24 is a timing chart showing a strobe signal and a control signal for electronically actuating another one of the thermal head driver circuits for developing the cyan, magenta and yellow dots on the image-forming substrate of FIG. 1.

When all of the color image-pixel signals "SC", "SM" and "SY" included in the respective single-lines have a values of "0", the control signal "DA" is maintained at a low-level, as shown in a timing chart of FIG. 24 and TABLE III of FIG. 25. Also, in this case, all of the 2-bit gradation signals "GSC", "GSM" and "GSY" have 2-bit data [00], and all of the 4-bit control signals "$DVB_n$" have 4-bit data [0000], whereby the n high-frequency voltage power sources 90 output no high-frequency voltage. Namely, none of the n piezoelectric elements $PZ_n$ are electrically energized.

When only one of the digital cyan image-pixel signals "SC" included in the single-line has a value of "1", the control signal "DA" is outputted as a high-level pulse "PC" (FIG. 24) from the control signal generator 88 to a corresponding AND-gate circuit 84. The high-level pulse "PC" has a pulse width "PWC" shorter than a pulse width "PW" of the strobe signal "STB", as shown in the timing chart of FIG. 24, and thus the electric heater 60 is electrically energized over a period of time corresponding to the pulse width "PWC" of the high-level pulse "PC", whereby the electric heater 60 is heated to a temperature in the range between the glass-transition temperatures $T_1$ and $T_2$ (FIG. 3). Namely, all of the n piezoelectric elements $PZ_n$ are heated in the range between the glass-transition temperatures $T_1$ and $T_2$.

On the other hand, when the 2-bit gradation signal "GSC", carried by the digital cyan image-pixel signals "SC" having the value "1", has 2-bit data [01], the 4-bit control signal generator 92 generates the 4-bit control signal "$DVB_n$" having 4-bit data [0001], and then outputs the generated 4-bit control signal [0001] to a corresponding high-frequency voltage power source 90, as shown in TABLE III of FIG. 25. When the high-frequency voltage power source 90 receives the 4-bit control signal [0001], a high-frequency voltage signal $f_{C1}$ is outputted from the high-frequency voltage power source 90 to a corresponding piezoelectric element ($PZ_n$), whereby the piezoelectric element ($PZ_n$) concerned exerts a pressure $P_{C1}$ on the image-forming sheet 10 (FIG. 25). Thus, a cyan dot is developed on the microcapsule layer 14 at a dot area on which the pressure $P_{C1}$ is exerted.

Similarly, as is apparent from TABLE III of FIG. 25, when the 2-bit gradation signal "GSC", carried by the digital cyan image-pixel signals "SC" having the value "1", has 2-bit data [10], a corresponding piezoelectric element ($PZ_n$) exerts a pressure $P_{C2}$ on the image-forming sheet 10, whereby a cyan dot is developed on the microcapsule layer 14 at a dot area on which the pressure $P_{C2}$ is exerted. Also, when the 2-bit gradation signal "GSC", carried by the digital cyan image-pixel signals "SC" having the value "1", has 2-bit data [11], a corresponding piezoelectric element ($PZ_n$) exerts a pressure $P_{C3}$ on the image-forming sheet 10, whereby a cyan dot is developed on the microcapsule layer 14 at a dot area on which the pressure $P_{C3}$ is exerted.

As mentioned above, the pressure $P_{C3}$ is higher than the pressure $P_{C2}$, a number of cyan microcapsules, broken at the dot area on which the pressure $P_{C3}$ is exerted, is larger than a number of cyan microcapsules broken at the dot area on which the pressure $P_{C2}$ is exerted. Also, the pressure $P_{C2}$ is higher than the pressure $P_{C1}$, a number of cyan microcapsules, broken at the dot area on which the pressure $P_{C2}$ is exerted, is larger than a number of cyan microcapsules broken at the dot area on which the pressure $P_{C1}$ is exerted. Thus, it is possible to obtain a variation in density (gradation) of the cyan dot.

When only one of the digital magenta image-pixel signals "SM" included in the single-line has a value "1", the control signal "DA" is outputted as a high-level pulse "PM" (FIG. 24) from the control signal generator 88 to a corresponding AND-gate circuit 84. The high-level pulse "PM" has a pulse width "PWM", which is longer than the pulse width "PWC" of the high-level pulse "PC", but is shorter than the pulse width "PW" of the strobe signal "STB", as shown in the timing chart of FIG. 24. Thus, the electric heater 60 is electrically energized over a period of time corresponding to the pulse width "PWM" of the high-level pulse "PM", whereby the electric heater 60 is heated to a temperature in the range between the glass-transition temperatures $T_2$ and $T_3$ (FIG. 3). Namely, all of the n piezoelectric elements $PZ_n$ are heated in the range between the glass-transition temperatures $T_2$ and $T_3$.

On the other hand, when the 2-bit gradation signal "GSM", carried by the digital magenta image-pixel signals "SM" having the value "1", has 2-bit data [01], the 4-bit control signal generator 92 generates the 4-bit control signal "$DVB_n$" having 4-bit data [0100], and then outputs the generated 4-bit control signal [0100] to a corresponding high-frequency voltage source 90, as shown in TABLE III of FIG. 25. When the high-frequency voltage power source 90 receives the 4-bit control signal [0100], a high-frequency voltage signal $f_{M1}$ is outputted from the high-frequency voltage power source 90 to a corresponding piezoelectric element ($PZ_n$), whereby the piezoelectric element ($PZ_n$) concerned exerts a pressure $P_{M1}$ on the image-forming sheet 10 (FIG. 25). Thus, a magenta dot is developed on the microcapsule layer 14 at a dot area on which the pressure $P_{M1}$ is exerted.

Similarly, as is apparent from TABLE III of FIG. 25, when the 2-bit gradation signal "GSM", carried by the digital magenta image-pixel signals "SM" having the value "1", has 2-bit data [10], a corresponding piezoelectric element ($PZ_n$) exerts a pressure $P_{M2}$ on the image-forming sheet 10, whereby a magenta dot is developed on the microcapsule layer 14 at a dot area on which the pressure $P_{M2}$ is exerted. Also, when the 2-bit gradation signal "GSM", carried by the digital magenta image-pixel signals "SM" having the value "1", has 2-bit data [11], a corresponding piezoelectric element ($PZ_n$) exerts a pressure $P_{M3}$ on the image-forming sheet 10, whereby a magenta dot is developed on the microcapsule layer 14 at a dot area on which the pressure $P_{M3}$ is exerted.

As mentioned above, the pressure $P_{M3}$ is higher than the pressure $P_{M2}$, a number of magenta microcapsules broken at the dot area on which the pressure $P_{M3}$ is exerted, is larger than a number of magenta microcapsules broken at the dot area on which the pressure $P_{M2}$ is exerted. Also, the pressure $P_{M2}$ is higher than the pressure $P_{M1}$, a number of magenta microcapsules, broken at the dot area on which the pressure $P_{M2}$ is exerted, is larger than a number of magenta microcapsules broken at the dot area on which the pressure $P_{M1}$ is exerted. Thus, it is possible to obtain a variation in density (gradation) of the magenta dot.

When only one of the digital yellow image-pixel signals "SY" included in the single-line has a value "1", the control signal "DA" is outputted as a high-level pulse "PY" (FIG. 24) from the control signal generator 88 to a corresponding AND-gate circuit 84. The high-level pulse "PY" has a pulse width "PWY", which is the same as the pulse width "PW" of the strobe signal "STB", as shown in the timing chart of FIG. 24, and thus the electric heater 60 is electrically energized over a period of time corresponding to the pulse width "PWY" of the high-level pulse "PY", whereby the electric heater 60 is heated to a temperature in the range between the glass-transition temperature $T_3$ and the upper limit temperature $T_{UP}$ (FIG. 3). Namely, all of the n piezoelectric elements $PZ_n$ are heated in the range between the glass-transition temperature $T_3$ and the upper limit temperature $T_{UP}$.

On the other hand, when the 2-bit gradation signal "GSY", carried by the digital yellow image-pixel signals "SY" having the value "1", has 2-bit data [01], the 4-bit control signal generator 92 generates the 4-bit control signal "$DVB_n$" having 4-bit data [0111], and then outputs the generated 4-bit control signal [0111] to a corresponding high-frequency voltage power source 90, as shown in TABLE III of FIG. 25. When the high-frequency voltage power source 90 receives the 4-bit control signal [0111], a high-frequency voltage signal $f_{Y1}$ is outputted from the high-frequency voltage power source 90 to a corresponding piezoelectric element ($PZ_n$), whereby the piezoelectric element ($PZ_n$) concerned exerts a pressure $P_{Y1}$ on the image-forming sheet 10 (FIG. 25). Thus, a yellow dot is developed on the microcapsule layer 14 at a dot area on which the pressure $P_{Y1}$ is exerted.

Similarly, as is apparent from TABLE III of FIG. 25, when the 2-bit gradation signal "GSY", carried by the digital yellow image-pixel signals "SY" having the value "1", has 2-bit data [10], a corresponding piezoelectric element ($PZ_n$) exerts a pressure $P_{Y2}$ on the image-forming sheet 10, whereby a yellow dot is developed on the microcapsule layer 14 at a dot area on which the pressure $P_{Y2}$ is exerted. Also, when the 2-bit gradation signal "GSY", carried by the digital yellow image-pixel signals "SY" having the value "1", has 2-bit data [11], a corresponding piezoelectric element ($PZ_n$) exerts a pressure $P_{Y3}$ on the image-forming sheet 10, whereby a yellow dot is developed on the microcapsule layer 14 at a dot area on which the pressure $P_{Y3}$ is exerted.

As mentioned above, the pressure $P_{Y3}$ is higher than the pressure $P_{Y2}$, a number of yellow microcapsules, broken at the dot area on which the pressure $P_{Y3}$ is exerted, is larger than a number of yellow microcapsules broken at the dot area on which the pressure $P_{Y2}$ is exerted. Also, the pressure $P_{Y2}$ is higher than the pressure $P_{Y1}$, a number of yellow microcapsules, broken at the dot area on which the pressure $P_{Y2}$ is exerted, is larger than a number of yellow microcapsules broken at the dot area on which the pressure $P_{Y1}$ is exerted. Thus, it is possible to obtain a variation in density (gradation) of the yellow dot.

Although the above-mentioned embodiments are directed to a formation of a color image, the present invention may be applied to a formation of a monochromatic image. In this case, a layer of only one type of microcapsules filled with, for example, a black ink.

Finally, it will be understood by those skilled in the art that the foregoing description is of preferred embodiments of the image-forming system, and that various changes and modifications may be made to the present invention without departing from the spirit and scope thereof.

The present disclosure relates to subject matters contained in Japanese Patent Application No. 9-331299 (filed on Nov. 14, 1997), which is expressly incorporated herein, by reference, in its entirety.

What is claimed is:

1. An image-forming system comprising:

an image-forming substrate that includes a base member, and a layer of microcapsules, coated over said base member, containing a plurality of at least one type of microcapsules filled with a dye, said one type of microcapsules exhibiting a temperature/pressure characteristic such that, when a local area of said layer of microcapsules is simultaneously subjected to a pressure in a predetermined pressure range and to a temperature in a predetermined temperature range, at least a portion of said plurality of at least one type of microcapsules, included in said local area, are squashed and broken, so that said dye discharges from said squashed and broken microcapsules; and an image-forming unit that includes a pressure applicator that exerts said pressure on said local area, a thermal heater that applies thermal energy to said local area to heat said local area to said temperature, and a regulator that regulates a degree of said application of said thermal energy to said local area, so that a variation in density of said discharged dye at said local area is obtainable.

2. An image-forming system as set forth in claim 1, wherein said regulator includes a determiner that determines whether said application of said thermal energy to said local area is performed in accordance with image information, said regulation of said application of said thermal energy to said local area being carried out in accordance with gradation information included in said image information.

3. An image-forming system as set forth in claim 1, wherein said local area is a dot area corresponding to a pixel unit of an image to be formed on said layer of microcapsules.

4. The image forming system according to claim 1, wherein said microcapsules bear a significantly higher pressure than said pressure at an ambient temperature without being squashed and broken.

5. An image-forming system comprising:

an image-forming substrate that includes a base member, and a layer of microcapsules, coated over said base member, containing a plurality of first type of microcapsules filled with a first dye, and a plurality of second type of microcapsules filled with a second dye, said first type of microcapsules exhibiting a first temperature/pressure characteristic such that, when a first local area of said layer of microcapsules is simultaneously subjected to a first pressure in a first predetermined pressure range at a first temperature in a first predetermined temperature range, and to least a portion of said plurality of first type of microcapsules, included in said first local area, are squashed and broken, so that said first dye discharges from said squashed and broken microcapsules in said first type, said second type of microcapsules exhibiting a second temperature/pressure characteristic such that, when a second local area of said layer of microcapsules is subjected to a second pressure in a second predetermined pressure range at a second temperature in a second predetermined temperature range, at least a portion of said plurality of second type of microcapsules, included in said second local area, are squashed and broken, so that said second dye discharges from said squashed and broken microcapsules in said second type;

a first image-forming unit that includes a first pressure applicator that exerts said first pressure on said first local area, a first thermal heater that applies first thermal energy to said first local area to heat said first local area to said first temperature, and a first regulator that regulates a degree of said application of said first thermal energy to said first local area, so that a variation in density of said discharged first dye at said first local area is obtainable; and a second image-forming unit that includes a second pressure applicator that exerts said second pressure on said second local area, a second thermal heater that applies second thermal energy to said second local area to heat said second local area to said second temperature, and a second regulator that regulates a degree of said application of said second thermal energy to said second local area, so that a variation in density of said discharged second dye at said second local area is obtainable, wherein said discharged first dye and said discharged second dye are mixed with each other when said first and second local areas coincide with each other.

6. An image-forming system as set forth in claim 5, wherein said first regulator includes a first determiner that determines whether said application of said first thermal energy to said first local area is performed in accordance with first image information, said regulation of said application of said first thermal energy to said first local area being carried out in accordance with first gradation information included in said first image information, and said second regulator includes a second determiner that determines whether said application of said second thermal energy to said second local area is performed in accordance with second image information, said regulation of said application of said second thermal energy to said second local area being carried out in accordance with second gradation information included in said second image information.

7. An image-forming system as set forth in claim 5, wherein each of said first and second local area is a dot area corresponding to a pixel unit of an image to be formed on said layer of microcapsules.

8. The image forming system according to claim 5, wherein said microcapsules bear a significantly higher pressure than said pressure at an ambient temperature without being squashed and broken.

9. An image-forming system comprising:

an image-forming substrate that includes a base member, and a layer of microcapsules, coated over said base member, containing a plurality of at least one type of microcapsules filled with a dye, said one type of microcapsules exhibiting a temperature/pressure characteristic such that, when a local area of said layer of microcapsules is subjected to a pressure in a predetermined pressure range at a temperature in a predetermined temperature range, at least a portion of said plurality of at least one type of microcapsules, included in said local area, are squashed and broken, so that said dye discharges from said squashed and broken microcapsules; and an image-forming unit that includes a pressure applicator that exerts said pressure on said local area, a thermal heater that applies a thermal energy to said local area to heat said local area to said temperature, and a regulator that regulates an amount of said pressure exerted on said local area, so that a variation in density of said discharged dye at said local area is obtainable.

10. An image-forming system as set forth in claim 9, wherein said regulator includes a determiner that determines whether said exertion of said pressure on said local area is performed in accordance with image information, said regulation of said pressure exerted on said local area being carried out in accordance with gradation information included in said image information.

11. An image-forming system as set forth in claim 9, wherein said local area is a dot area corresponding to a pixel unit of an image to be formed on said layer of microcapsules.

12. An image-forming system as set forth in claim 9, wherein said pressure applicator comprises a piezoelectric element which is electrically energized by a high frequency voltage to exert said pressure on said local area.

13. The image forming system according to claim 9, wherein said microcapsules bear a significantly higher pressure than said pressure at an ambient temperature without being squashed and broken.

14. An image-forming system comprising:

an image-forming substrate that includes a base member, and a layer of microcapsules, coated over said base member, containing a plurality of first type of microcapsules filled with a first dye, and a plurality of second type of microcapsules filled with a second dye, said first type of microcapsules exhibiting a first temperature/pressure characteristic such that, when a first local area of said layer of microcapsules is simultaneously subjected to a first pressure in a first predetermined pressure range and to a first temperature in a first predetermined temperature range, at least a portion of said plurality of first type of microcapsules, included in said first local area, are squashed and broken, so that said first dye discharges from said squashed and broken microcapsules in said first type, said second type of microcapsules exhibiting a second temperature/pressure characteristic such that, when a second local area of said layer of microcapsules is subjected to a second pressure in a second predetermined pressure range at a second temperature in a second predetermined temperature range, at least a portion of said plurality of second type of microcapsules, included in said second local area, are squashed and broken, so that said second dye discharges from said squashed and broken microcapsules in said second type; and an image-forming unit that includes a pressure applicator that selectively exerts said first and second pressures on said first and second local areas, respectively, a thermal heater that selectively applies first thermal energy and second thermal energy to said first and second local areas to heat said first and second local areas to said first and second temperatures, respectively, and a regulator that independently regulates a first degree of said application of said first thermal energy to said first local area and a second degree of said application of said second thermal energy to said second local area, respectively, so that a variation in density of said discharged first dye at said first local area and a variation in density of said discharged second dye at said second local area are obtainable, respectively, wherein said discharged first dye and said discharged second dye are mixed with each other when said first and second local areas coincide with each other.

15. An image-forming system as set forth in claim 14, wherein said first regulator includes a determiner that independently determines whether said application of said first thermal energy to said first local area and said application of said second thermal energy to said second local area are performed in accordance with first image information and second image information, respectively, said regulation of said application of said first thermal energy to said first local area and said regulation of said application of said second thermal energy to said second local area being carried out in accordance with first gradation information included in said first image information and second gradation information included in said second image information, respectively.

16. An image-forming system as set forth in claim 14, wherein each of said first and second local area is a dot area corresponding to a pixel unit of an image to be formed on said layer of microcapsules.

17. The image forming system according to claim 14, wherein said microcapsules bear a significantly higher pressure than said pressure at an ambient temperature without being squashed and broken.

18. An image-forming apparatus that forms an image on an image-forming substrate that includes a base member, and a layer of microcapsules, coated over said base member, containing a plurality of at least one type of microcapsules filled with a dye, said one type of microcapsules exhibiting a temperature/pressure characteristic such that, when a local area of said layer of microcapsules is simultaneously subjected to a pressure in a predetermined pressure range and to a temperature in a predetermined temperature range, at least a portion of said plurality of at least one type of microcapsules, included in said local area, are squashed and broken, so that said dye discharges from said squashed and broken microcapsules to form said image, said image-forming apparatus comprising:

a pressure applicator that exerts said pressure on said local area;

a thermal heater that applies thermal energy to said local area to heat said local area to said temperature; and a regulator that regulates a degree of said application of said thermal energy to said local area, so that a variation in density of said discharged dye at said local area is obtainable.

19. The image forming system according to claim 18, wherein said microcapsules bear a significantly higher pressure than said pressure at an ambient temperature without being squashed and broken.

20. An image-forming apparatus that forms an image on an image-forming substrate that includes a base member, and a layer of microcapsules, coated over said base member, containing a plurality of first type of microcapsules filled with a first dye, and a plurality of second type of microcapsules filled with a second dye, said first type of microcapsules exhibiting a first temperature/pressure characteristic such that, when a first local area of said layer of microcapsules is simultaneously subjected to a first pressure in a first predetermined pressure range and to a first temperature in a first predetermined temperature range, at least a portion of said plurality of first type of microcapsules, included in said first local area, are squashed and broken, so that said first dye discharges from said squashed and broken microcapsules in said first type to partially form said image, said second type of microcapsules exhibiting a second temperature/pressure characteristic such that, when a second local area of said layer of microcapsules is subjected to a second pressure in a second predetermined pressure range at a second temperature in a second predetermined temperature range, at least a portion of said plurality of second type of microcapsules, included in said second local area, are squashed and broken, so that said second dye discharges from said squashed and broken microcapsules in said second type to partially form said image, said image-forming apparatus comprising:

a first pressure applicator that exerts said first pressure on said first local area;

a first thermal heater that applies first thermal energy to said first local area to heat said first local area to said first temperature;

a first regulator that regulates a degree of said application of said first thermal energy to said first local area, so that a variation in density of said discharged first dye at said first local area is obtainable;

a second pressure applicator that exerts said second pressure on said second local area;

a second thermal heater that applies second thermal energy to said second local area to heat said second local area to said second temperature; and a second regulator that regulates a degree of said application of said second thermal energy to said second local area, so that a variation in density of said discharged second dye at said second local area is obtainable, wherein said discharged first dye and said discharged second dye are mixed with each other when said first and second local areas coincide with each other.

21. The image forming system according to claim 20, wherein said microcapsules bear a significantly higher pressure than said pressure at an ambient temperature without being squashed and broken.

22. An image-forming apparatus that forms an image on an image-forming substrate that includes a base member, and a layer of microcapsules, coated over said base member, containing a plurality of at least one type of microcapsules filled with a dye, said one type of microcapsules exhibiting a temperature/pressure characteristic such that, when a local area of said layer of microcapsules is subjected to a pressure in a predetermined pressure range at a temperature in a predetermined temperature range, at least a portion of said plurality of at least one type of microcapsules, included in said local area, are squashed and broken, so that said dye discharges from said squashed and broken microcapsules to form said image, said image-forming apparatus comprising:

a pressure applicator that exerts said pressure on said local area;

a thermal heater that applies thermal energy to said local area to heat said local area to said temperature; and a regulator that regulates an amount of said pressure exerted on said local area, so that a variation in density of said discharged dye at said local area is obtainable.

23. An image-forming apparatus as set forth in claim 22, wherein said pressure applicator comprises a piezoelectric element which is electrically energized by a high frequency voltage to exert said pressure on said local area.

24. The image forming system according to claim 22, wherein said microcapsules bear a significantly higher pressure than said pressure at an ambient temperature without being squashed and broken.

25. An image-forming apparatus that forms an image on an image-forming substrate that includes a base member, and a layer of microcapsules, coated over said base member, containing a plurality of first type of microcapsules filled with a first dye, and a plurality of second type of microcapsules filled with a second dye, said first type of microcapsules exhibiting a first temperature/pressure characteristic such that, when a first local area of said layer of microcapsules is simultaneously subjected to a first pressure in a first predetermined pressure range and to a first temperature in a first predetermined temperature range, at least a portion of said plurality of first type of microcapsules, included in said first local area, are squashed and broken, so that said first dye discharges from said squashed and broken microcapsules in said first type to partially form said image, said second type of microcapsules exhibiting a second temperature/pressure characteristic such that, when a second local area of said layer of microcapsules is subjected to a second pressure in a second predetermined pressure range at a second temperature in a second predetermined temperature range, at least a portion of said plurality of second type of microcapsules, included in said second local area, are squashed and broken, so that said second dye discharges from said squashed and broken microcapsules in said second type to partially form said image, said image-forming apparatus comprising:

a pressure applicator that selectively exerts said first and second pressures on said first and second local areas, respectively;

a thermal heater that selectively applies first thermal energy and second thermal energy to said first and second local areas to heat said first and second local areas to said first and second temperatures, respectively; and a regulator that independently regulates a first degree of said application of said first thermal energy to said first local area and a second degree of said application of said second thermal energy to said second local area, respectively, so that a variation in density of said discharged first dye at said first local area and a variation in density of said discharged second dye at said second local area are obtainable, respectively.

wherein said discharged first dye and said discharged second dye are mixed with each other when said first and second local areas coincide with each other.

26. The image forming system according to claim 25, wherein said microcapsules bear a significantly higher pressure than said pressure at an ambient temperature without being squashed and broken.

* * * * *